US011324327B2

(12) United States Patent
Grossman et al.

(10) Patent No.: US 11,324,327 B2
(45) Date of Patent: May 10, 2022

(54) FURNITURE OBJECTS FOR STORING FOLDABLE BEDS

(71) Applicant: Night and Day Furniture LLC, Vancouver, WA (US)

(72) Inventors: Joel Grossman, Petaling Jaya (MY); Howard Porter, Kuala Lumpur (MY)

(73) Assignee: NIGHT AND DAY FURNITURE LLC, Vancouver, WA (US)

( * ) Notice: Subject to any disclaimer, the term of this patent is extended or adjusted under 35 U.S.C. 154(b) by 610 days.

(21) Appl. No.: 15/828,913

(22) Filed: Dec. 1, 2017

(65) Prior Publication Data

US 2019/0167008 A1 Jun. 6, 2019

(51) Int. Cl.

| | |
|---|---|
| ***A47C 17/58*** | (2006.01) |
| ***A47C 17/60*** | (2006.01) |
| ***A47C 17/54*** | (2006.01) |
| ***A47C 19/02*** | (2006.01) |
| ***A47C 19/12*** | (2006.01) |
| ***A47C 17/56*** | (2006.01) |
| ***A47C 17/52*** | (2006.01) |

(52) U.S. Cl.

CPC ..... *A47C 17/58* (2013.01); *A47C 17/54* (2013.01); *A47C 17/60* (2013.01); *A47C 19/022* (2013.01); *A47C 19/024* (2013.01); *A47C 19/12* (2013.01); *A47C 17/52* (2013.01); *A47C 17/56* (2013.01)

(58) Field of Classification Search

CPC ..... A47C 17/38; A47C 17/42; A47C 17/46; A47C 17/48; A47C 17/44; A47C 17/52; A47C 17/54; A47C 17/56; A47C 17/58; A47C 17/60; A47C 19/022; A47C 19/024; A47C 19/12

See application file for complete search history.

(56) References Cited

U.S. PATENT DOCUMENTS

| | | | | | |
|---|---|---|---|---|---|
| 3,792 | A | * | 10/1844 | Kingman | A47C 19/122 5/152 |
| 83,936 | A | * | 11/1868 | Crosby | A47C 19/122 5/152 |
| 157,719 | A | * | 12/1874 | Iverson | A47C 19/122 5/152 |
| 201,282 | A | * | 3/1878 | Ogborn | A47C 17/60 5/151 |
| RE8,270 | E | * | 6/1878 | Maine | 5/159.1 |
| 431,825 | A | * | 7/1890 | Sundback | A47C 19/122 5/152 |
| 791,857 | A | * | 6/1905 | Arnold | A47C 17/40 5/164.1 |

(Continued)

OTHER PUBLICATIONS

Office Action dated Jan. 28, 2019 by the Canadian Intellectual Property Office for CA Application No. 2,990,536.

*Primary Examiner* — Peter M. Cuomo
*Assistant Examiner* — Morgan J McClure
(74) *Attorney, Agent, or Firm* — Harness, Dickey & Pierce, P.L.C.

(57) ABSTRACT

A chest may be configured to transition between an open position and a closed position, the chest including an enclosure configured to store a foldable mattress supported by a sleeping platform when the foldable mattress is in an unfolded state. The chest may include a top panel, a front panel, and side panels, the top panel configured to be manually lifted off of the chest to form a lower portion of the sleeping platform.

20 Claims, 34 Drawing Sheets

(56) References Cited

U.S. PATENT DOCUMENTS 981,402 A * 1/1911 Eschenbruecher .... A47C 17/60 5/5
1,023,562 A * 4/1912 Haberman ..... A47C 17/48 5/157
1,567,258 A * 12/1925 Galik ..... A47C 17/54 5/2.1
1,639,163 A * 8/1927 Burger ..... A47C 17/40 5/152
1,987,592 A * 1/1935 Bodmer ..... A47C 17/40 5/498
2,356,321 A * 8/1944 Irick ..... A47C 17/60 5/152
2,544,762 A * 3/1951 Lochridge ..... A47C 17/48 5/6
2,577,741 A * 12/1951 Creveling ..... A47C 17/04 297/109
2,641,000 A * 6/1953 Jonsson ..... A47C 17/48 5/155
2,788,528 A * 4/1957 Hansen ..... A47C 17/62 5/6
2,856,612 A * 10/1958 Wheeler ..... A47C 17/136 5/2.1
3,097,369 A * 7/1963 Emch ..... A47C 17/40 5/136
3,581,318 A * 6/1971 Kroupa ..... A47B 85/00 5/2.1
3,638,249 A * 2/1972 Katsigarakis ..... A47C 17/60 5/159.1
3,703,735 A * 11/1972 Moore ..... A47C 17/38 5/147
3,858,253 A * 1/1975 Lauzon ..... A47C 17/62 5/2.1
3,863,281 A * 2/1975 Tosic ..... A47C 17/52 5/136
3,965,498 A * 6/1976 Boni ..... A47C 17/58 5/6
4,300,761 A * 11/1981 Howard ..... A63B 17/00 482/130
4,793,011 A * 12/1988 Eve ..... A47C 17/58 5/136
5,400,447 A * 3/1995 Pokorny ..... A47C 17/58 5/138
5,522,102 A * 6/1996 Vayda ..... A47C 17/38 5/133
6,401,276 B1 * 6/2002 Sherman ..... A47B 5/06 5/133
6,851,139 B2 * 2/2005 Arason ..... A47C 19/122 5/152
8,006,327 B1 * 8/2011 Burchett ..... A47C 17/38 5/133
D712,676 S * 9/2014 Flora ..... D6/384
8,943,624 B1 * 2/2015 Youngstrom ..... A47C 19/22 5/131
D742,136 S * 11/2015 Flora ..... D6/384
9,289,063 B2 * 3/2016 Baugh ..... A47B 83/04
9,370,244 B1 * 6/2016 Kumar ..... A47B 85/00
9,549,618 B1 * 1/2017 Honarvar ..... A47B 63/00
9,744,400 B2 * 8/2017 Cole ..... A63B 22/0089
D814,830 S * 4/2018 Flora ..... D6/664
D884,395 S * 5/2020 Flora ..... D6/663
2001/0049843 A1 * 12/2001 Barnett ..... A47C 19/122 5/159.1
2006/0031986 A1 * 2/2006 Revels ..... A47C 17/38 5/136
2006/0225210 A1 * 10/2006 Arason ..... A47C 17/48 5/159.1
2006/0230530 A1 * 10/2006 Avishay ..... A47C 17/48 5/136
2008/0229497 A1 * 9/2008 Paoutoff ..... A47C 17/42 5/136
2010/0043142 A1 * 2/2010 Whitford ..... A47C 17/46 5/136
2012/0073045 A1 * 3/2012 Grubb ..... A47C 17/52 5/136
2016/0022048 A1 * 1/2016 Flora ..... A47C 17/60 5/149
2016/0037934 A1 * 2/2016 Porter ..... A47C 17/58 5/174
2016/0058196 A1 * 3/2016 Grubb ..... A47C 17/54 5/159.1
2019/0343292 A1 * 11/2019 Porter ..... A47C 19/12

* cited by examiner

FURNITURE OBJECTS FOR STORING FOLDABLE BEDS

FIELD

Example embodiments relate generally to furniture objects configured to store foldable beds.

BACKGROUND

The statements in this section merely provide background information related to example embodiments and may not constitute prior art.

Often, furniture apparatuses capable of more than one function are used in environments (e.g., residential, commercial, etc.) where space is limited. For example, foldable beds, such as sofa beds, futon beds or other like, may be used in such environments as sitting furniture (e.g., couches, sofas, etc.) and lying and/or sleeping furniture (e.g., beds, etc.). In such environments, these foldable beds may make more efficient use of the limited space and may relieve the need for additional furniture. However, even these foldable beds may take up too much space in certain environments.

SUMMARY

Some example embodiments relate to a chest configured to transition between an open position and a closed position, the chest including an enclosure configured to store a foldable mattress supported by a sleeping platform when the foldable mattress is in an unfolded state.

In some example embodiments, the chest includes a top panel, a front panel, and side panels, the top panel configured to be manually lifted off of the chest to form a lower portion of the sleeping platform.

In some example embodiments, the top panel includes legs extending in a direction perpendicular to a top surface of the top panel such that the top surface and the legs are liftable as one unitary piece off of the chest.

In some example embodiments, the legs of the top panel are configured to support the lower portion of the sleeping platform.

In some example embodiments, the chest further includes a folding slat deck within the enclosure, the folding slat deck configured to transition between an unfolded state and a folded state such that the folding slat deck separates the enclosure into a top portion and bottom portion when the folding slat deck is in the unfolded state, and combines the top portion and the bottom portion of the enclosure into a single usable space when the folding slat deck is in the folded state.

In some example embodiments, a first one of the folding slat deck and the side panels includes protrusions and a second one of the folding stat deck and the side panels include openings corresponding to the protrusions such that the folding slat deck is pivotably connected to the side panels.

In some example embodiments, the folding slat deck forms an upper portion of the sleeping platform when the folding slat deck is in the unfolded state.

In some example embodiments, the foldable mattress is storable in the single usable space when the folding slat deck is in the folded state.

In some example embodiments, the chest further includes the foldable mattress, the foldable mattress configured to transition between a folded position and an unfolded position based on whether the chest is in the closed position and the open position, respectively.

In some example embodiments, the foldable mattress is in the folded position when stored in the enclosure, and the foldable mattress is in the unfolded position when the foldable mattress is supported by the sleeping platform.

In some example embodiments, the front panel is configured to transition between an upward position and a downward position, the front panel configured to form a middle portion of the sleeping platform when the front panel is in the downward position.

In some example embodiments, the front panel includes an upper front panel hingedly connected to a lower front panel, the upper front panel configured to transition between the upward position and the downward position.

In some example embodiments, the chest further includes a folding leg assembly connected to the upper front panel, the folding leg assembly configured to transition between a folded state and an unfolded state depending on whether the chest is in the closed position or the open position.

In some example embodiments, the folding leg assembly includes legs and a lock, the lock configured to lock the folding leg assembly in the unfolded state such that the legs contact a floor when the chest is in the open position to support the middle portion of the sleeping platform.

In some example embodiments, the front panel is a roll-out front panel, the roll-out front panel including a front leg assembly and a rear leg assembly, the front leg assembly and rear leg assembly both being rigidly connected to the roll-out front panel, the front leg assembly including rollers such that the roll-out front panel is configured to roll away from the chest when the chest is transitioning from the closed position to the open position.

In some example embodiments, the front panel is a hook-on front panel, the hook-on front panel including clawed edges corresponding to divots on an end of the top panel and the side panels such that, when the chest is in the open position, the hook-on front panel lies perpendicular to a direction of the hook-on front panel in the closed position and is suspended from by the clawed edges connecting to the end of the top panel and the side panels to form the middle portion of the sleeping platform.

In some example embodiments, the chest further includes at least one lift tray attached to one or more of the side panels and extending away from the chest, the at least one lift tray configured to support items placed thereon.

In some example embodiments, the at least one lift tray includes a pair of lift trays each attached to a respective one of the sides panels.

In some example embodiments, the chest further includes a back panel connected to the side panels such that the back panel is parallel to the front panel when the chest is in the closed position.

In some example embodiments, the back panel is a headboard when the chest is in the open position.

Some example embodiments relate to a chest configured to transition between an open position and a closed position, the chest including an enclosure configured to store a foldable mattress supported by a sleeping platform when the foldable mattress is in an unfolded state.

In some example embodiments, the chest includes a top panel, a front panel, and side panels, the top panel configured to form a lower portion of the sleeping platform; and a folding slat deck within the enclosure, the folding slat deck configured to transition between an unfolded state and a folded state such that the folding slat deck forms an upper portion of the sleeping platform when the folding slat deck is in the unfolded state and combines the top portion and the bottom portion of the enclosure into a storage space for the foldable mattress when the folding slat deck is in the folded state.

DRAWINGS

The drawings described herein are for illustration purposes only and are not intended to limit the scope of the present disclosure in any way.

FIG. 1 illustrates a front, left perspective view of a chest 100 configured to store a foldable bed 200 (also referred to as a foldable mattress 200) in a closed position (also referred to as a folded position) according to some example embodiments;

DESCRIPTION

Figure 1:
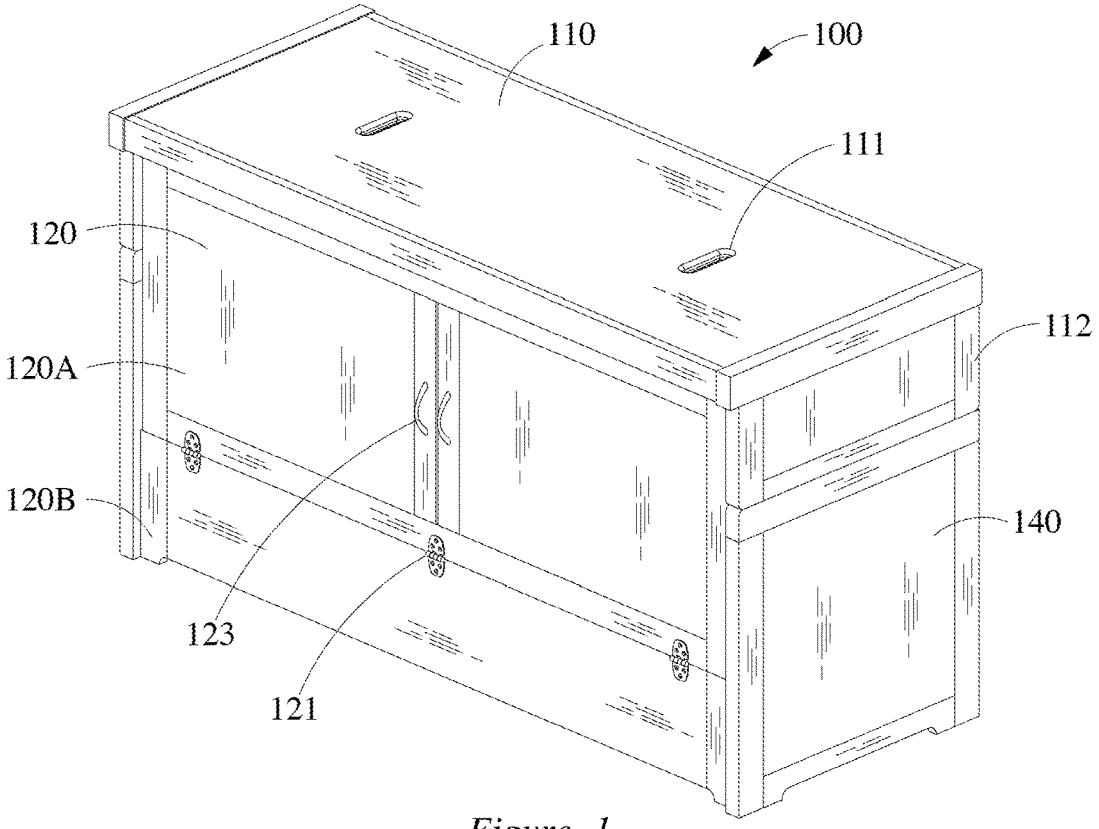

The following description is merely an example and is not intended to limit the present disclosure, application, or uses. It should be understood that throughout the drawings, corresponding reference numerals indicate like or corresponding parts and features.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the example embodiments to those skilled in the art.

Example embodiments relate to a furniture object configured to store a foldable bed. Example embodiments provide that the furniture object may be a chest, cabinet, coffer, trunk or any other like furniture object configured and/or adaptable to store a foldable bed. The furniture object described herein may be constructed, manufactured, or otherwise built in a variety of shapes include any rectangular shape, square shape, and/or any other like shape. The furniture objects described herein may be constructed, manufactured, or otherwise built using a variety of materials, such as wood, plastic, metal, minerals and/or any combination thereof.

Figure 2:
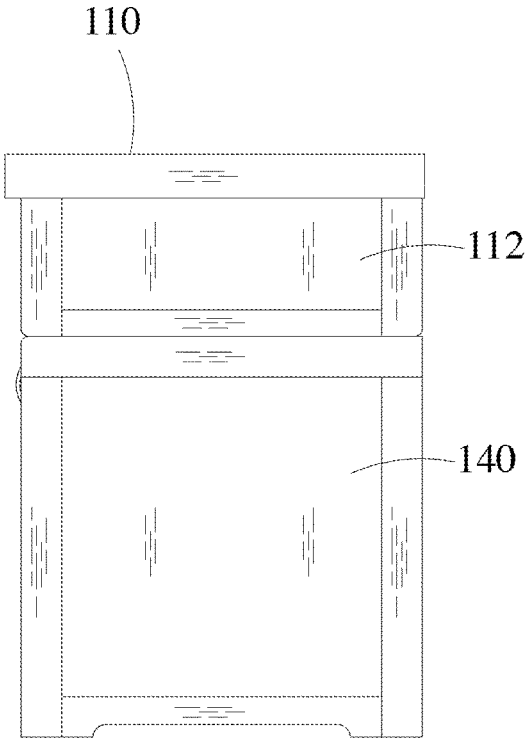
FIG. 2 is a side perspective view of a chest in a closed position (also referred to as a folded position) according to some example embodiments.
Figure 3:
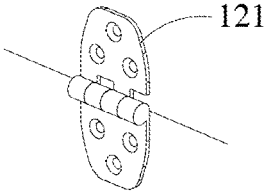
FIG. 3 illustrates a hinge according to some example embodiment
Figure 4:
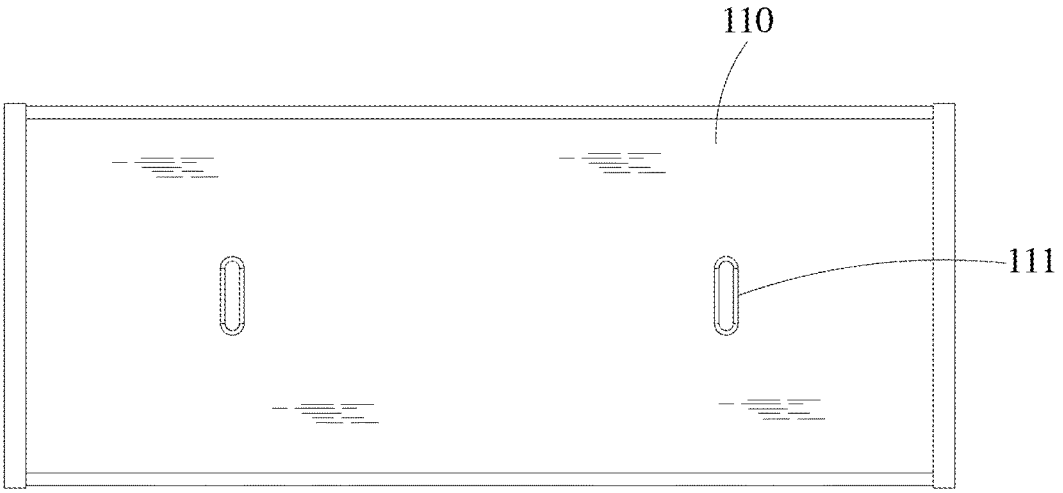
FIG. 4 is a top perspective view of a chest in a closed position (also referred to as a folded position) according to some example embodiments.
Figure 5:
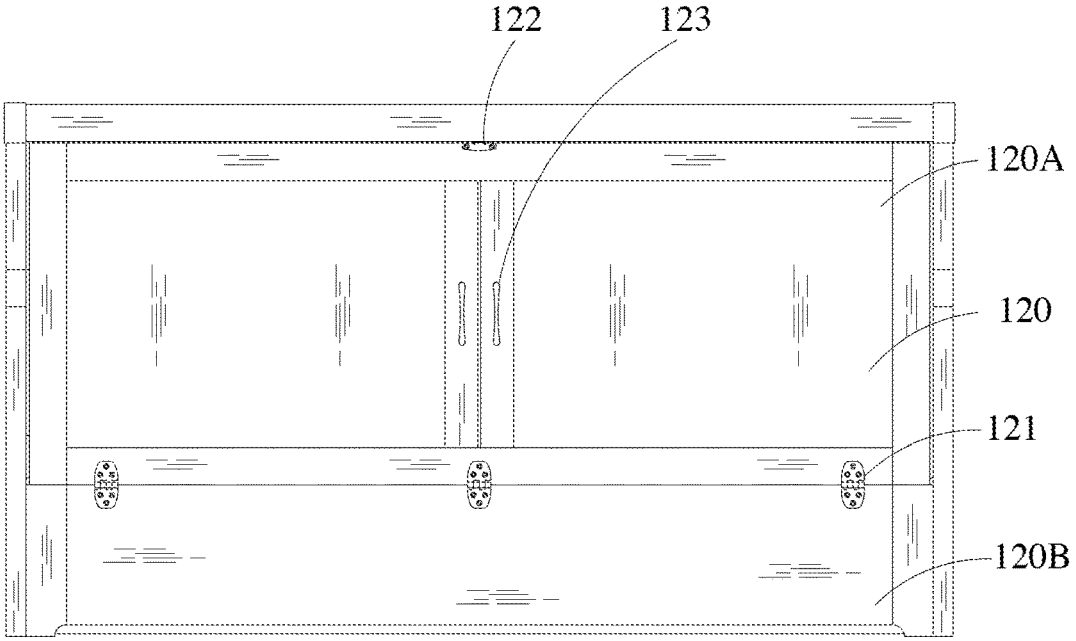
FIG. 5 is a front view of a chest in a closed position (also referred to as a folded position) according to some example embodiments.

FIG. 1 illustrates a front, left perspective view of a chest 100 configured to store a foldable bed 200 (also referred to as a foldable mattress 200) in a closed position (also referred to as a folded position) according to some example embodiments, FIG. 2 is a side perspective view, FIG. 4 is a top perspective view, and FIG. 5 is a front view of the same according to some example embodiments, and FIG. 3 illustrates a hinge according to some example embodiment.

Referring to FIGS. 1-5, the chest 100 includes a top panel (also referred to as a lift top) 110, a front panel 120, side panels 140, and back panel 150 (see FIG. 6), which may be visible when the chest 100 is in the closed position.

The top panel 110 includes one or more handles 111, for example two handles 111, used to manually lift the top panel 110 onto or off of the chest 100 to transition to the chest between the open position and the closed position. The handles 111 may be any type of handle, knob, latch, hook or and/or any other like protrusion or void that allows an operator to manually grip the top panel 110.

The top panel 110 may have legs 112 extending in a direction perpendicular to the surface of the top panel 110. The top panel may have a one piece design.

The front panel 120 includes an upper front panel 120A and a lower front panel 120B. As illustrated in FIG. 3, the upper front panel 120A and the lower front panel 120B may be connected via one or more hinges 121 or any other like mechanism, that connects the upper front panel 120A and the lower front panel 120B.

The upper front panel 120A may be configured to transition between an upward position in which the upper and lower front panels 120A, 120B are parallel, and a downward position in which the upper front panel 120A is perpendicular to the lower front panel 120B. The front panel may include one or more handles 123 that assist the operator opening the upper front panel 120A to the downward position. The handles 123 may be any type of handle, knob, latch, hook or and/or any other like protrusion or void that allows an operator to manually grip the top panel 110.

Further, as discussed below with reference to FIG. 15, a folding leg assembly 130 may be locked to the upper front panel 120A in an unfolded state via one or more fastening members 122.

Figure 6:
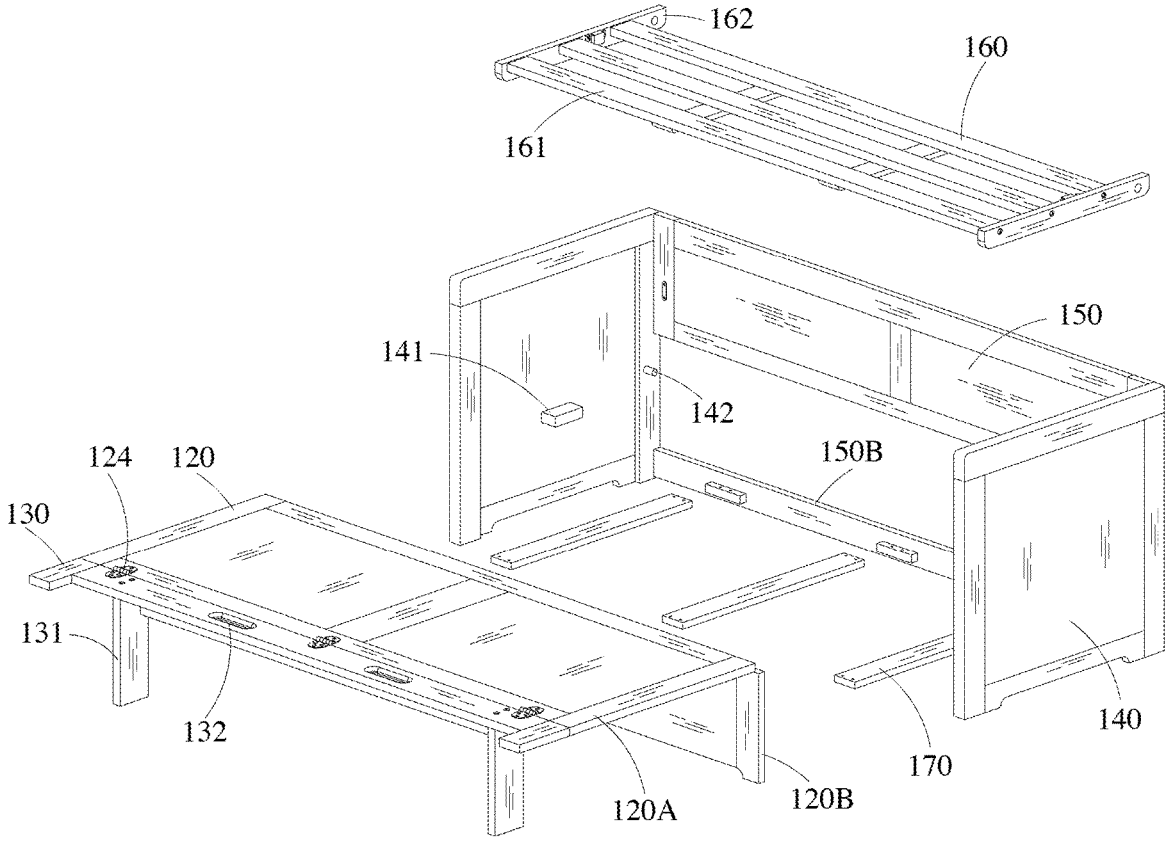
FIG. 6 is a front, left exploded view of a first portion of the chest in the open and/or unfolded position according to some example embodiments.

The side panels 140 may be connected to the lower front panel 120B and the back panel 150 (see FIG. 6). A height of the side panels 140 may be less than a height of the front panel 120 such that a sum of the height of the side panel 140 and the legs 112 of the top panel equals the height of the front panel 120.

Figure 14:
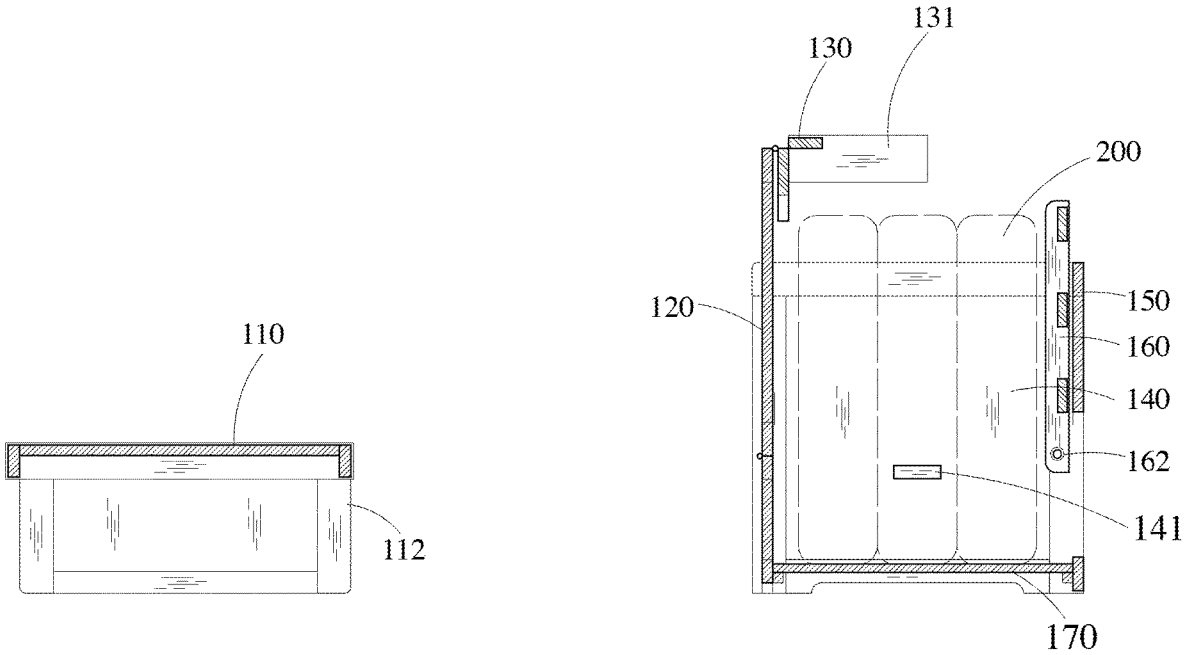

The chest 100 in the closed position is configured store the foldable mattress 200 (see FIG. 14) in an enclosure formed by the front panel 120, side panels 140, the back panel 150, and bottom slats 170 (see. FIG. 6). The foldable mattress 200 (see FIG. 14) may be in a folded position when stored in the enclosure.

Figure 7:
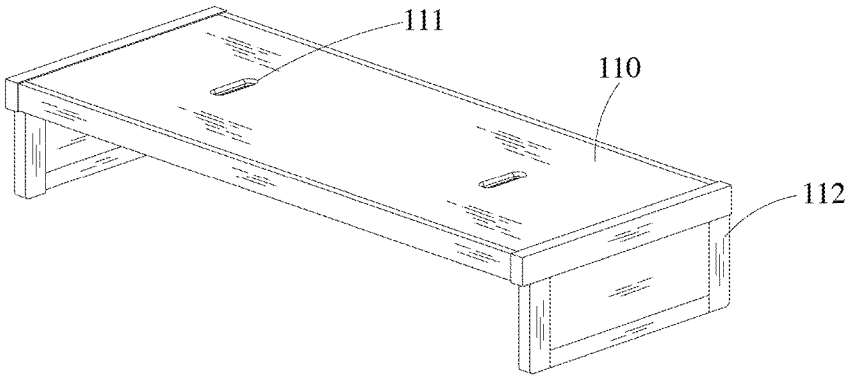
FIG. 7 is a front left perspective view of a second portion of the chest in the open and/or unfolded position according to some example embodiments.
Figure 8:
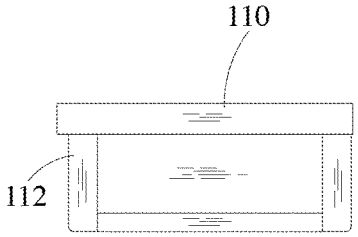
FIG. 8 is a side view of the second portion of the chest in the open and/or unfolded position according to some example embodiments.
Figure 9:
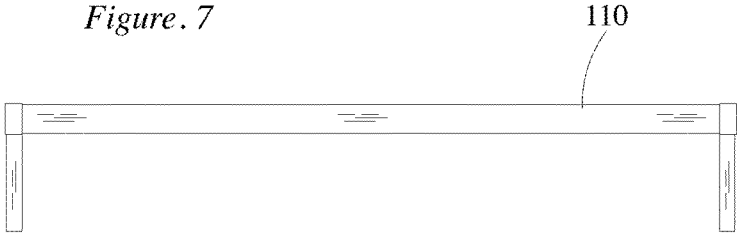
FIG. 9 is a side view of the first portion of the chest in the open and/or unfolded position according to some example embodiments.
Figure 10:
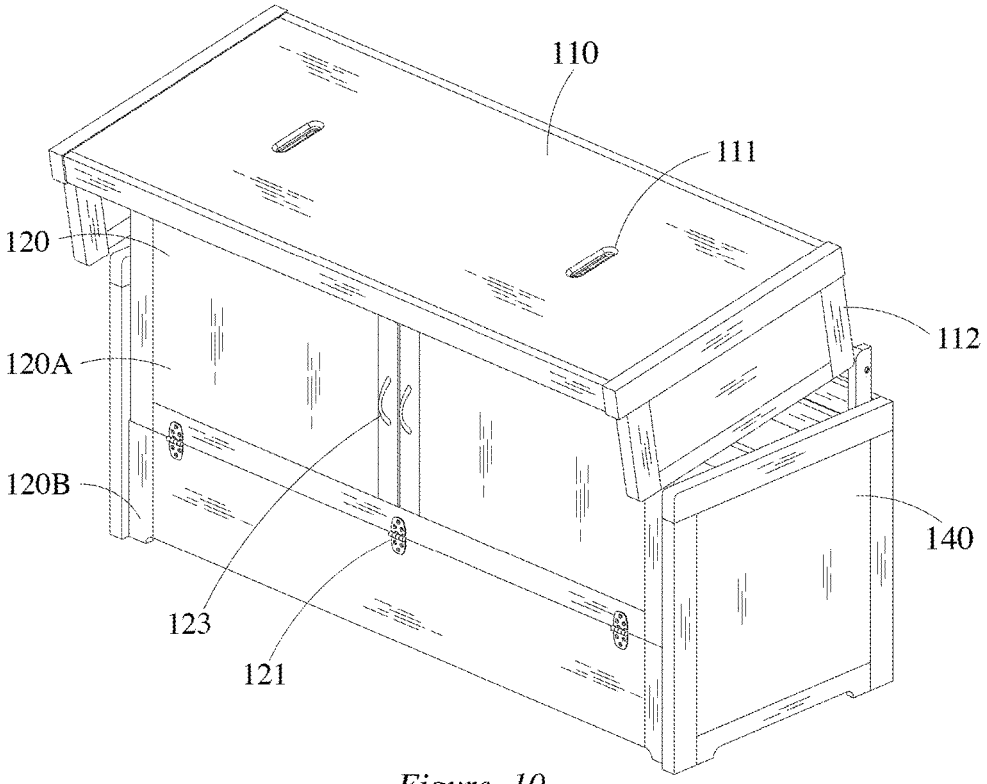
FIGS. 10 to 27 illustrate a method of unfolding a chest from a closed position to an open position according to example embodiments.

FIG. 6 is a front, left exploded view of a first portion of the chest 100 in the open and/or unfolded position according to some example embodiments. FIG. 7 is a front left perspective view of a second portion of the chest 100 in the open and/or unfolded position. FIG. 8 is a side view of the second portion of the chest 100 in the open and/or unfolded position, and FIG. 9 is a side view of the first portion of the chest 100 in the open and/or unfolded position.

Referring to FIGS. 6-9, in addition to the top panel 110, front panel 120, side panels 140, and back panel 150, which may be visible when the chest 100 is in the closed position, the chest 100 may further include a folding leg assembly 130, a folding slat deck 160, and bottom slats 170.

As discussed below, in the unfolded position, a sleeping platform may be arranged that includes an upper sleeping platform, a middle sleeping platform, and a lower sleeping platform, with a portion of the back panel 150 forming a headboard.

The folding leg assembly 130 may be connected to the front panel 120. For example, the folding leg assembly 130 may be connected to the upper front panel 120A of the front panel 120 via one or more or more hinges 124 or any other like mechanism that connects the folding leg assembly 130 to the front panel 120.

The folding leg assembly 130 may include legs 131 and handles 132. The handles 132 may be configured to assist in transitioning the upper front panel 120A between a raised and lowered state, and also folding and unfolding the folding leg assembly 130.

In regards to the middle sleeping platform, the folding leg assembly 130 is configured to switch between a folded state and an unfolded state depending on whether the chest 100 is in the closed or open position such that, in the unfolded position, the folding leg assembly 130 and the inside of the upper front panel 120A may extend horizontally on the same plane to form the middle sleeping platform.

Figure 11:
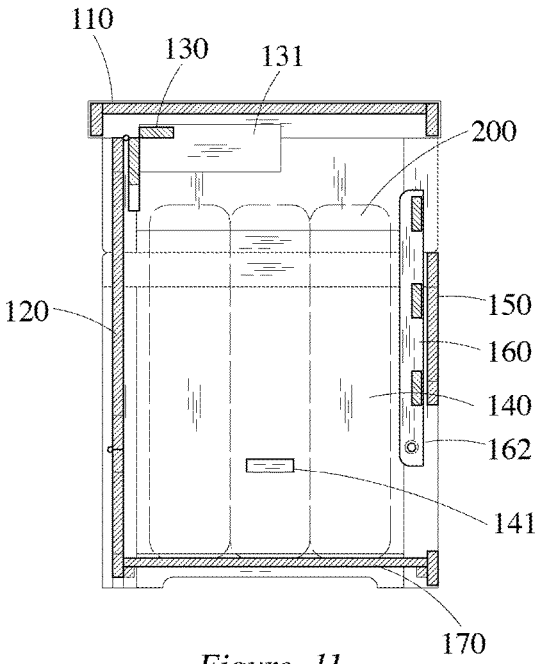

In the unfolded state, the legs 131 may be configured to rest on a floor to support the middle sleeping platform. In the folded state (see FIG. 11), the legs 131 may be configured to rest within the enclosure such that the legs 131 are positioned 180 degrees with respect to the upper front panel 120 as compared to the position of the legs 131 when the folding leg assembly 130 in the unfolded state. A height of the front panel 120A and position of the folding leg assembly 130 may be such that the top panel 110 is configured to cover and hide the folding leg assembly 130 when the chest 100 is in the folded position.

In some example embodiments, the height of the chest 100 may be reduced while still including a sleeping platform long enough to accommodate a conventional queen or king size mattress (e.g., 80 inches in length) by including the folding leg assembly 130 that is able to transition between the folded and unfolded states.

The folding slat deck 160 may include a plurality of slats 161 running in the lengthwise direction of the chest 100. The folding slat deck 160 may be pivotally connected to the side panels 140 via protrusions 142 protruding from the rear of side panels 140 connected to respective openings 162 in the rear of the folding slat deck 160. However, example embodiments are not limited thereto, for example, in other example embodiments, the protrusions 142 may be in the slat deck 160 and the openings 162 may be in the side panels 140. Further, in other example embodiments, the folding slat deck 160 may simply be manually liftable and/or foldable without including any pivotable connection between the folding slat deck 160 and the side panels 140.

By having the folding slat deck 160 foldable between the folded position and the unfolded position, the mattress 200 may sit substantially deeper in the enclosure until needed, thus, substantially reducing the height of the chest 100.

Figure 12:
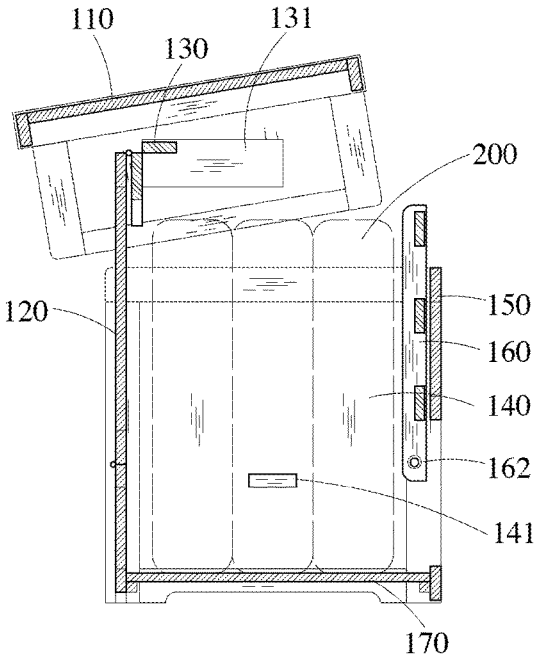
Figure 13:
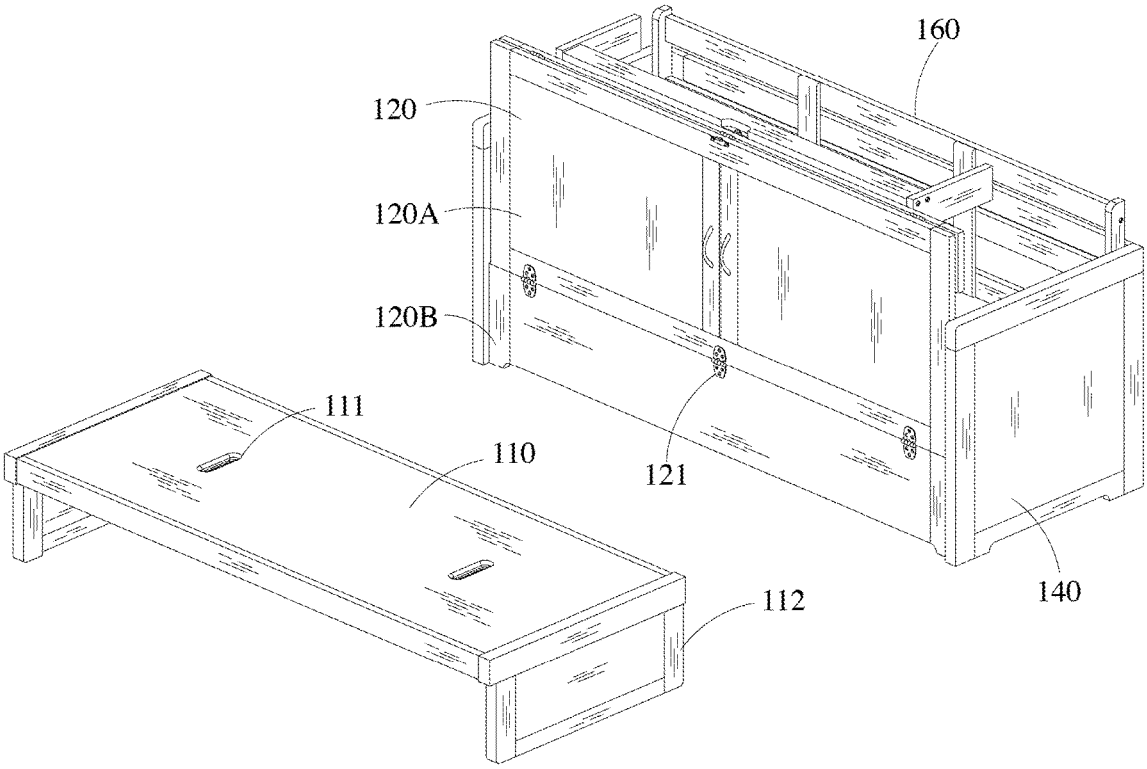

In regards to the upper sleeping platform, the folding slat deck 160 may transition between a folded position (see FIGS. 11 and 12) and an unfolded position (see FIG. 23), where the folding slat deck 160 may rest against supports 141 on the inside of the side panels 140 in the unfolded position to form the upper sleeping platform. The supports 141 may extend towards an interior of the enclosure an amount such that the supports 141 do not interfere with placement of the mattress 200 in the enclosure when the mattress 200 is in the closed position.

The bottom slats 170 may be connected between the rear panel 150 and the front panel 120, for example, between a lower rear panel 150B and the lower front panel 120B. The bottom slats 170 may be arranged as several discrete slats 170 that allow for a light weight design while providing stability and hold the weight of the foldable mattress 200 when the mattress 200 is in the closed position, or alternatively, the bottom slats 170 may be one solid platform on an opposite side of the enclosure from the top panel 110.

In regards to the lower sleeping platform, the top panel 110 when manually lifted and removed from the enclosure, may be positioned against or near the front panel 120 in the unfolded state to form the lower sleeping platform.

Thus, the sleeping platform may be formed simply and without the costs associated with telescoping rails by having the top panel 110 manually removable from enclosure by simply lifting the same and placing the top panel 110 on the floor to form the lower sleeping platform, folding the upper front panel 120A down and the folding leg assembly 130 out to form the middle sleeping platform, and lowering the folding slat deck 160 onto the supports 141 to form the upper sleeping platform.

FIGS. 10 to 27 illustrate a method of unfolding a chest from a closed position to an open position according to example embodiments.

Referring to FIGS. 10 to 27, as illustrated in FIGS. 10 to 14, first the top panel 110 may be lifted off of the chest 100 by the handles 111 and placed on the floor to expose the folding leg assembly 130.

Figure 15:
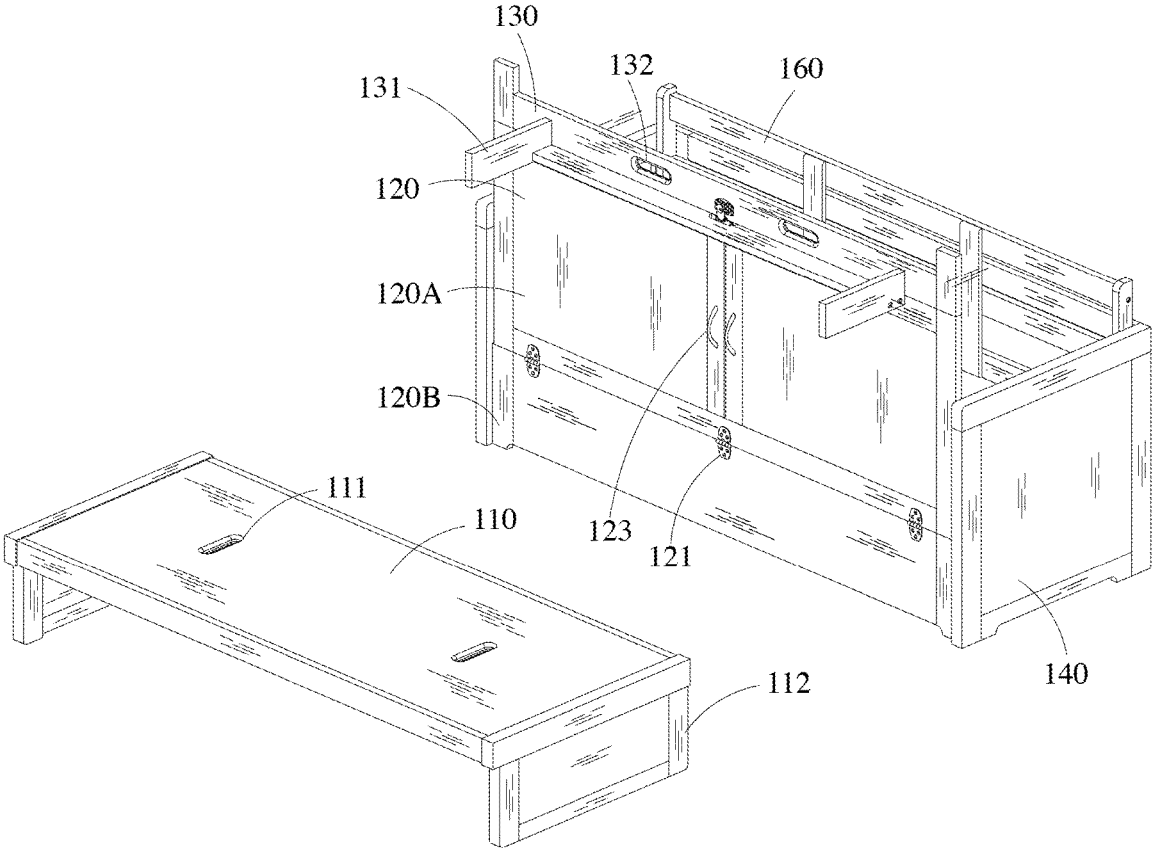
Figure 16:
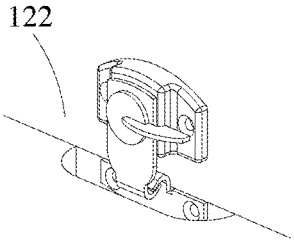
Figure 17:
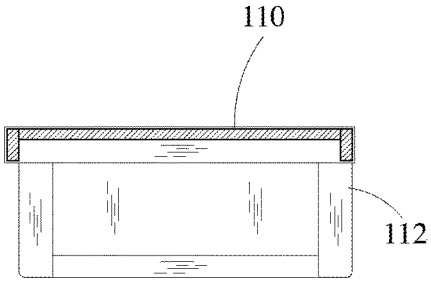
Figure 17:
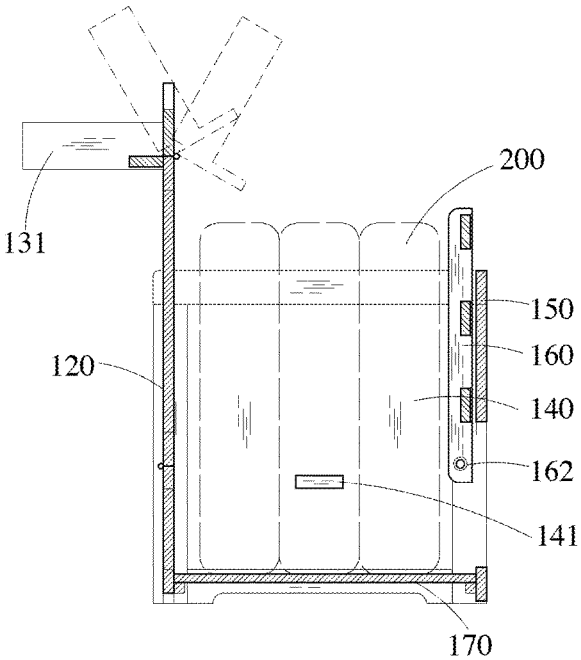

Next, as illustrated in FIGS. 15 to 17, the folding leg assembly 130 may be locked into the unfolded state via one or more pull latches 122, which may include a plate attached to the upper front panel 120A and a latch attached to the folding leg assembly 130. However, example embodiments are not limited thereto, for example, the plate may be attached to the folding leg assembly 130 and the latch may be attached to the upper front panel 120A.

Figure 18:
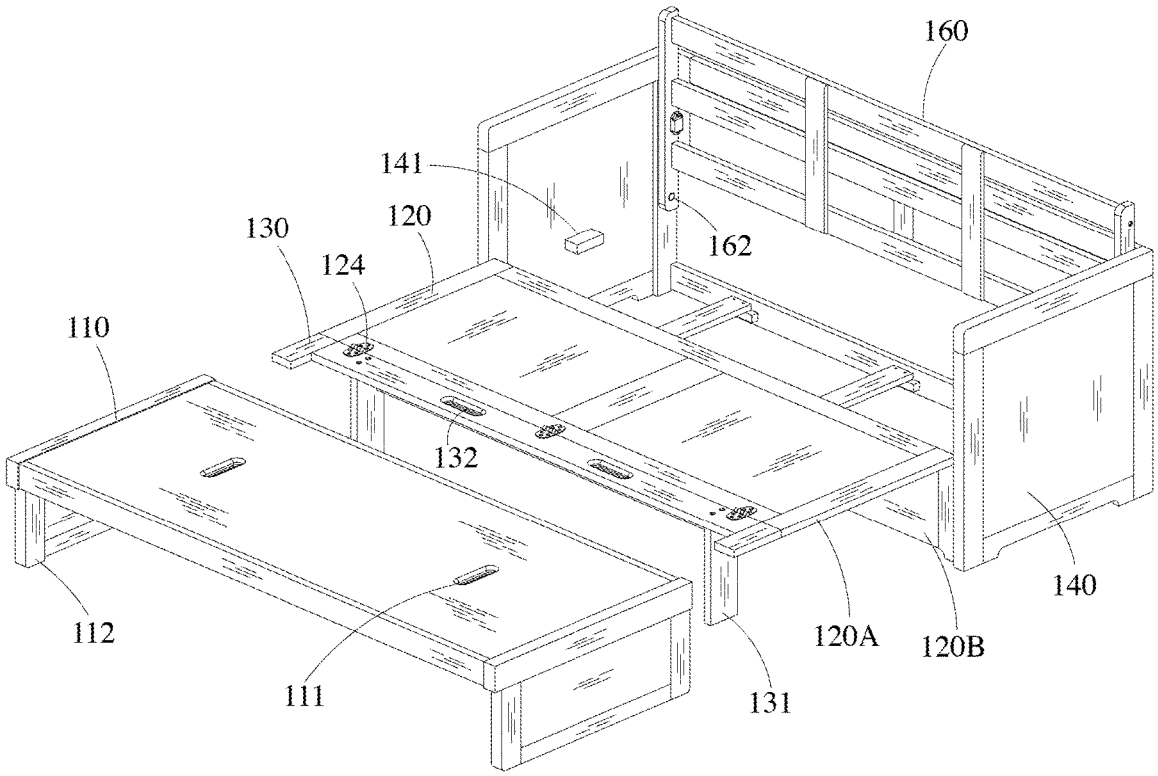
Figure 19:
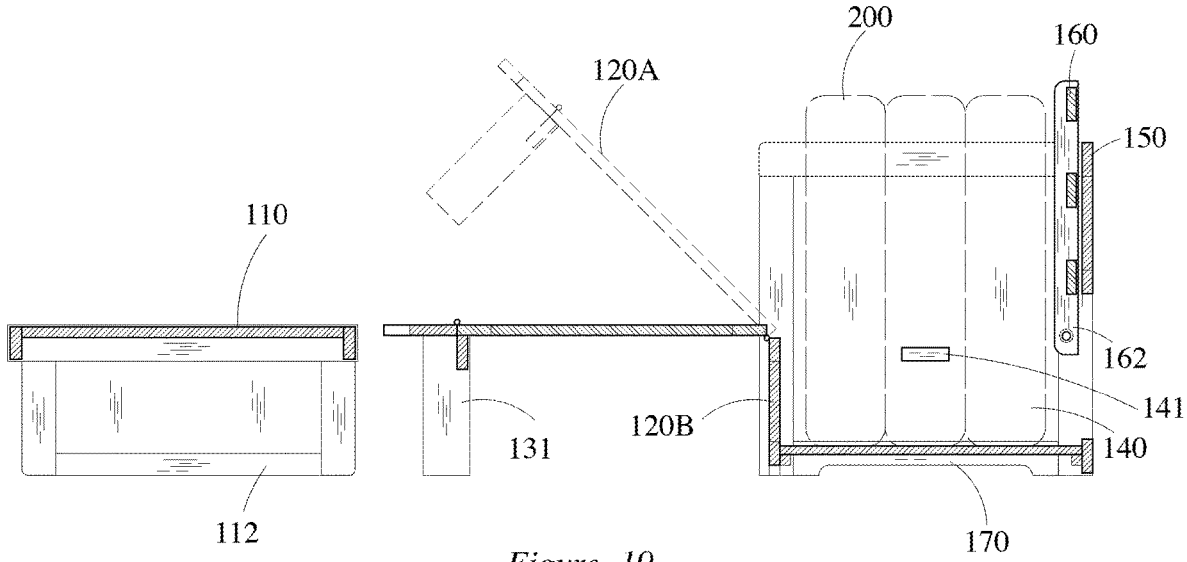

Thereafter, as illustrated in FIGS. 18 and 19, the upper front panel 120A (having the folding leg assembly 130 locked in the unfolded state thereto) may be lowered to the downward position via, for example, one or more of the handles 123, 132, until the legs 131 rest on the floor to form the middle sleeping platform.

Figure 20:
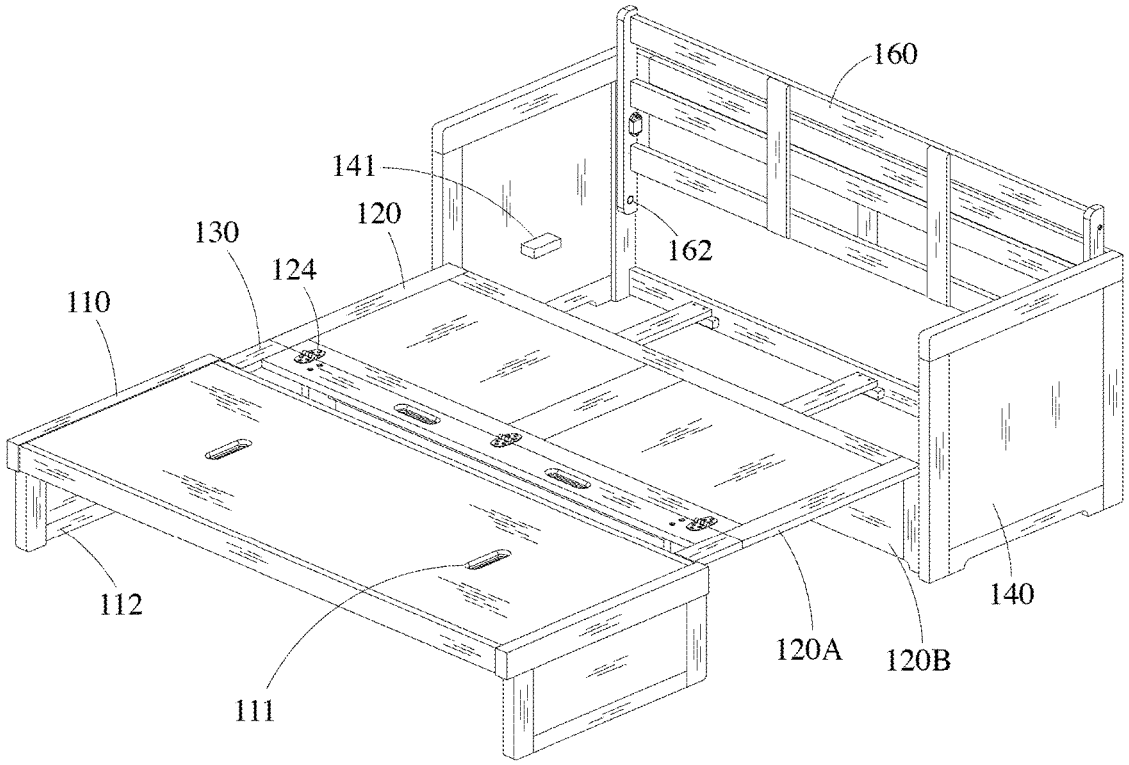
Figure 21:
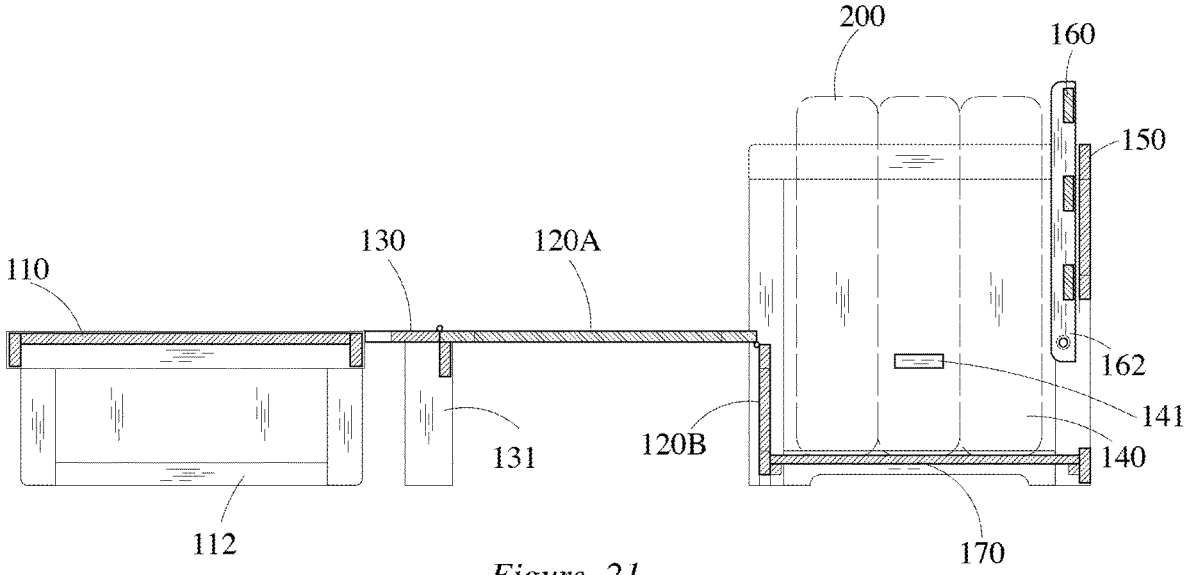

Next, as illustrated in FIGS. 20 and 21, the top panel 110 may be manually positioned adjacent to the folding leg assembly 130 to form the lower sleeping platform.

Figure 22:
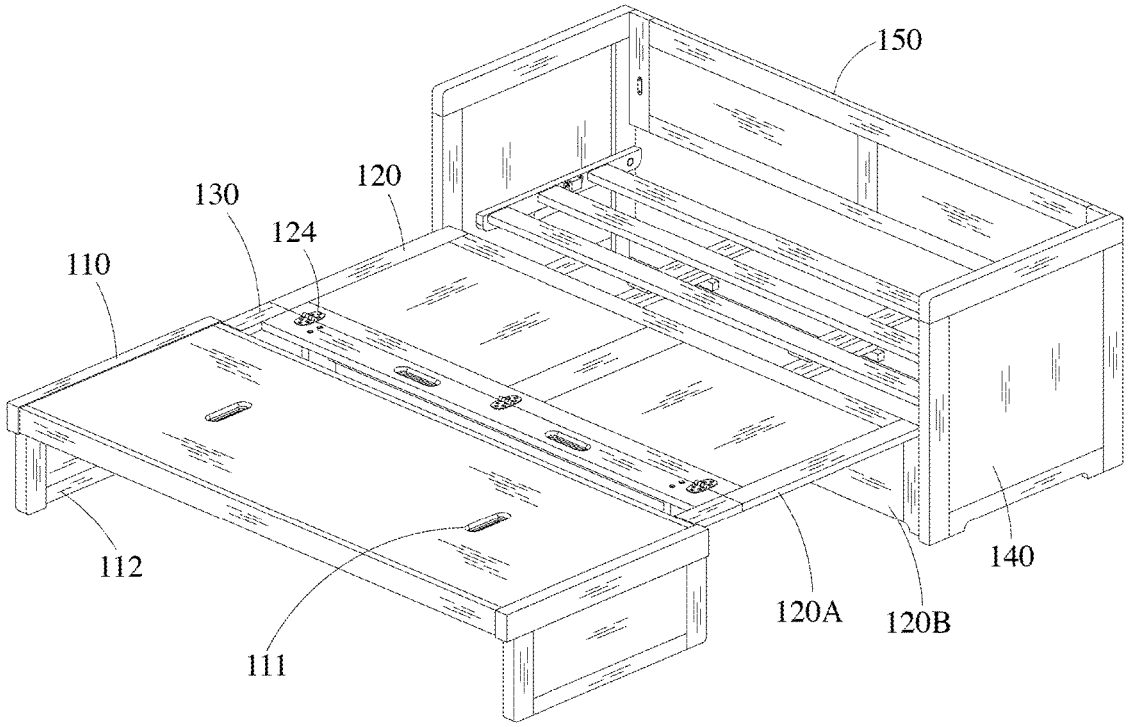
Figure 23:
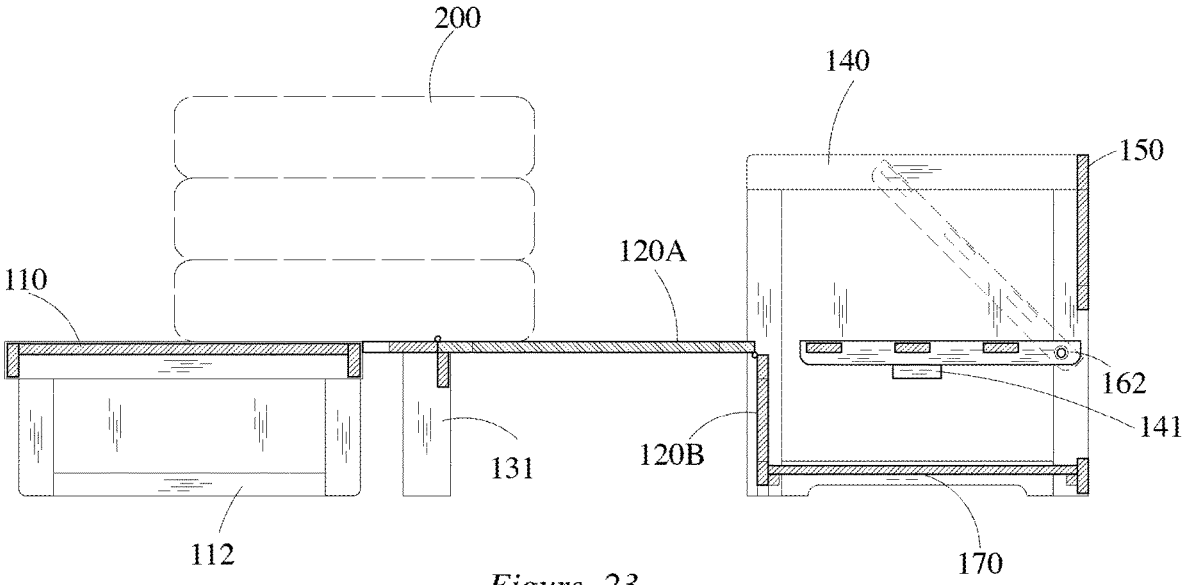

Thereafter, as illustrated in FIGS. 22 and 23, the mattress 200 may be removed from the enclosure and the folding slat deck 160 may be transitioned from the folded position to the unfolded position such that the folding slat deck 160 rests on the supports 141. By having the folding slat deck 160 pivotable between the folded position and the unfolded position, the height of the chest 100 may be reduced by allowing the mattress 200 to sit substantially deeper in the enclosure until needed.

Figure 24:
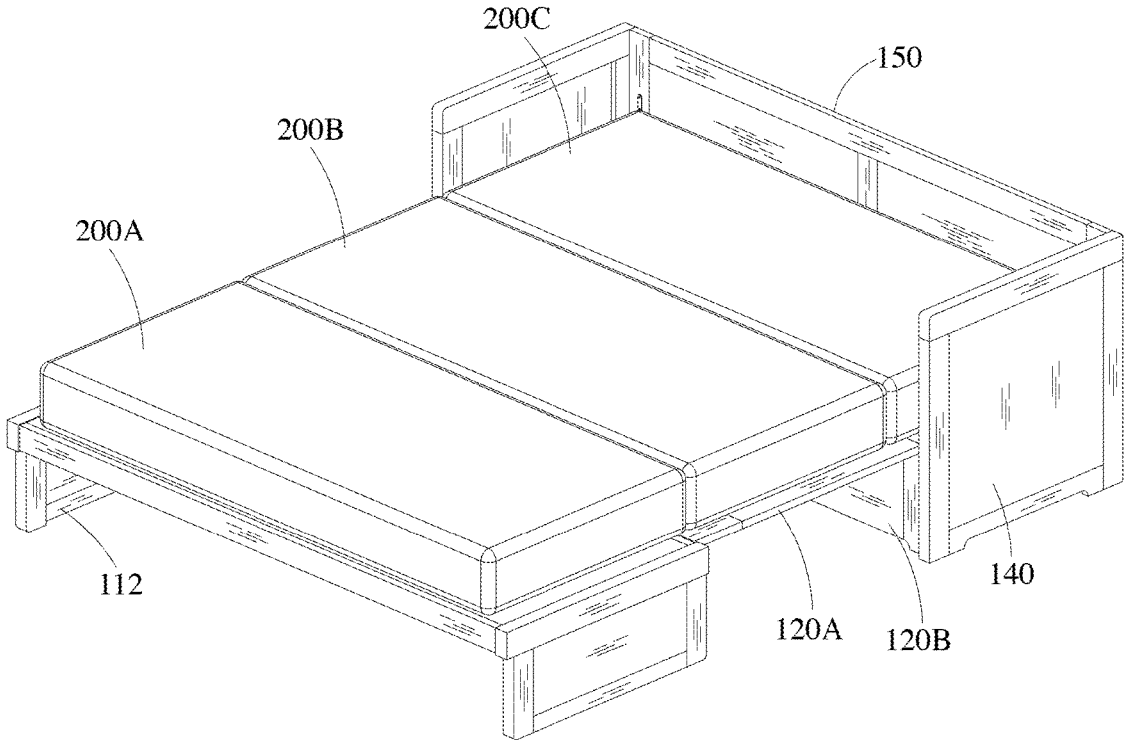
Figure 25:
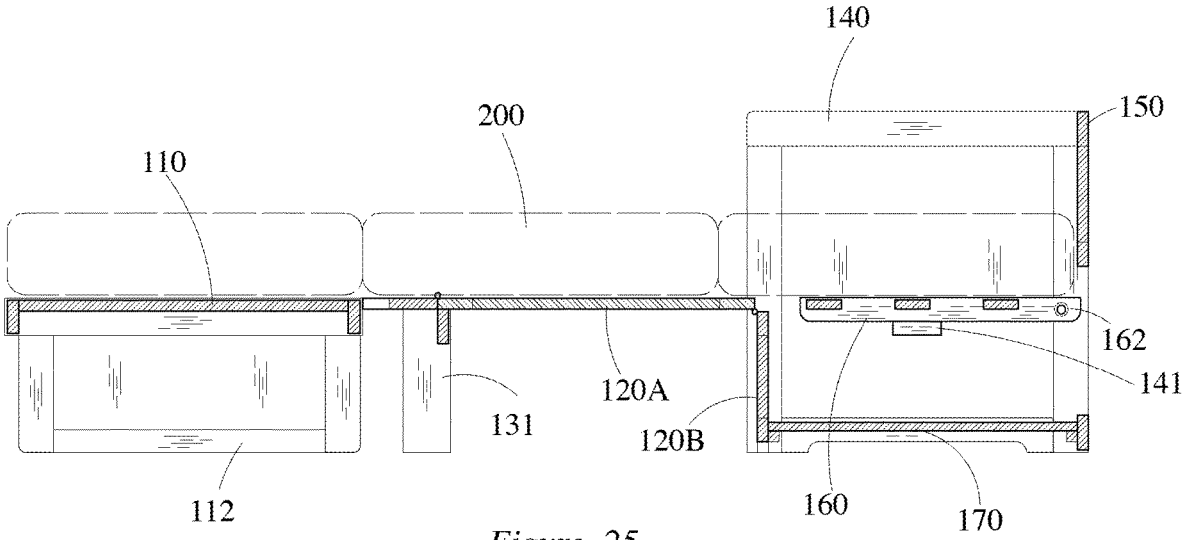
Figure 26:
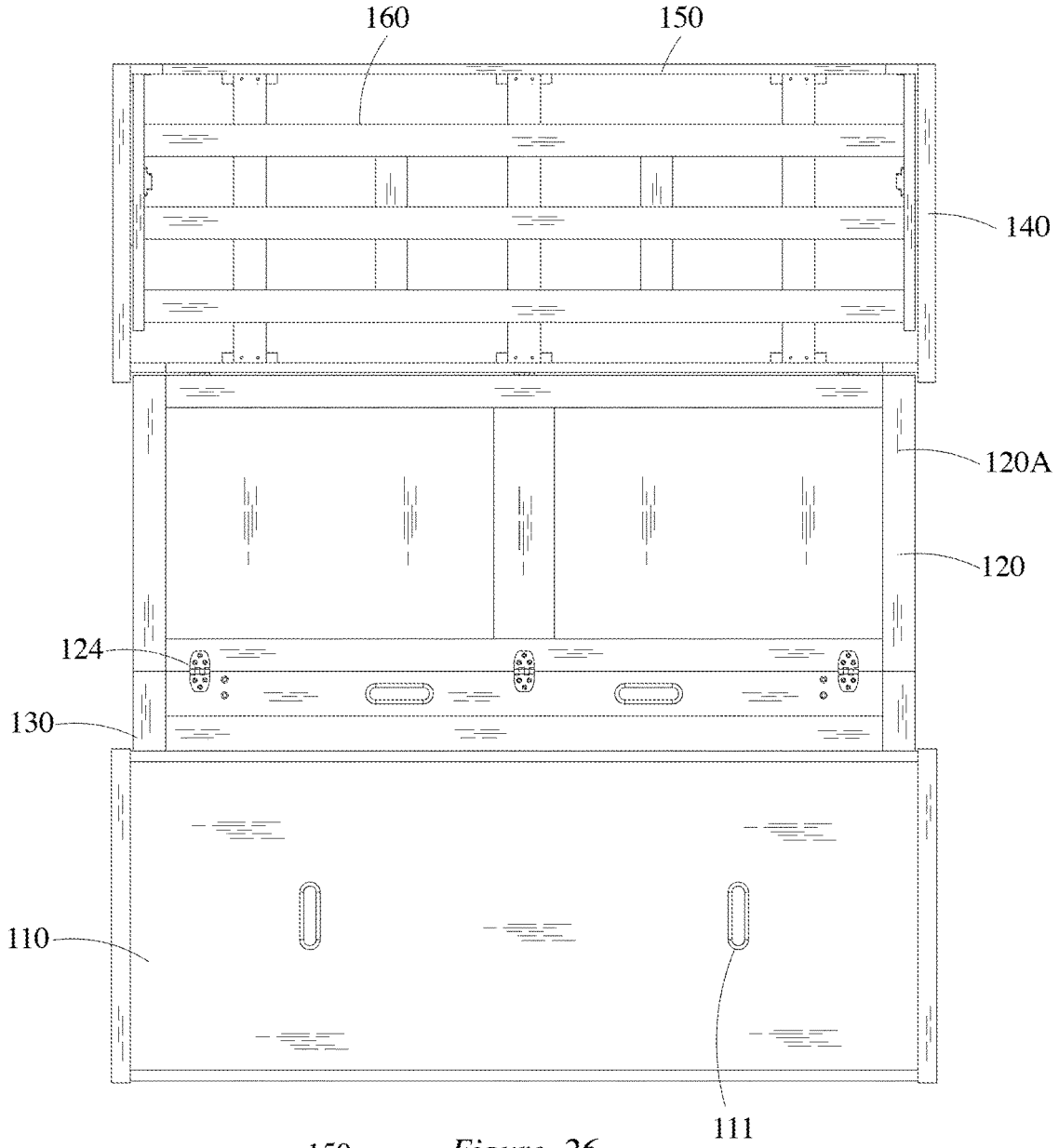
Figure 27:
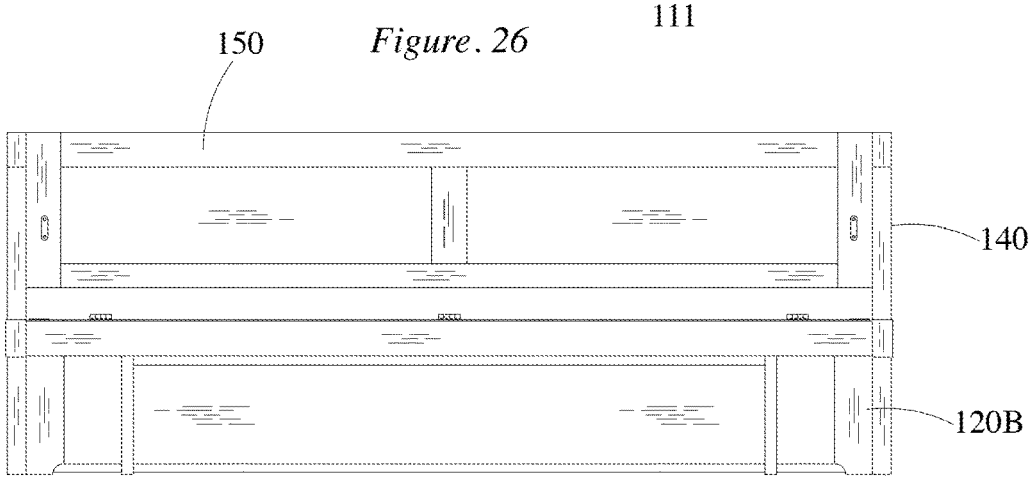
Figure 28:
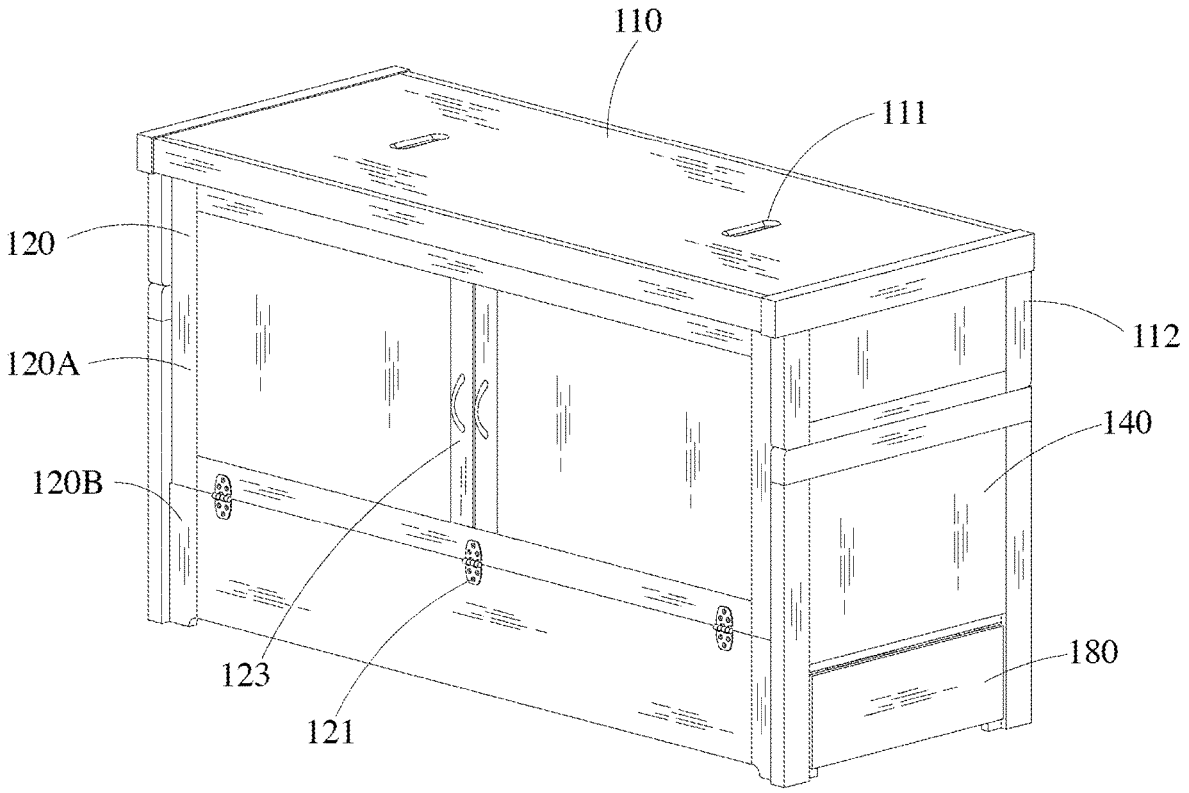
FIGS. 28 to 41 illustrate a chest according to some other example embodiments.
Figure 29:
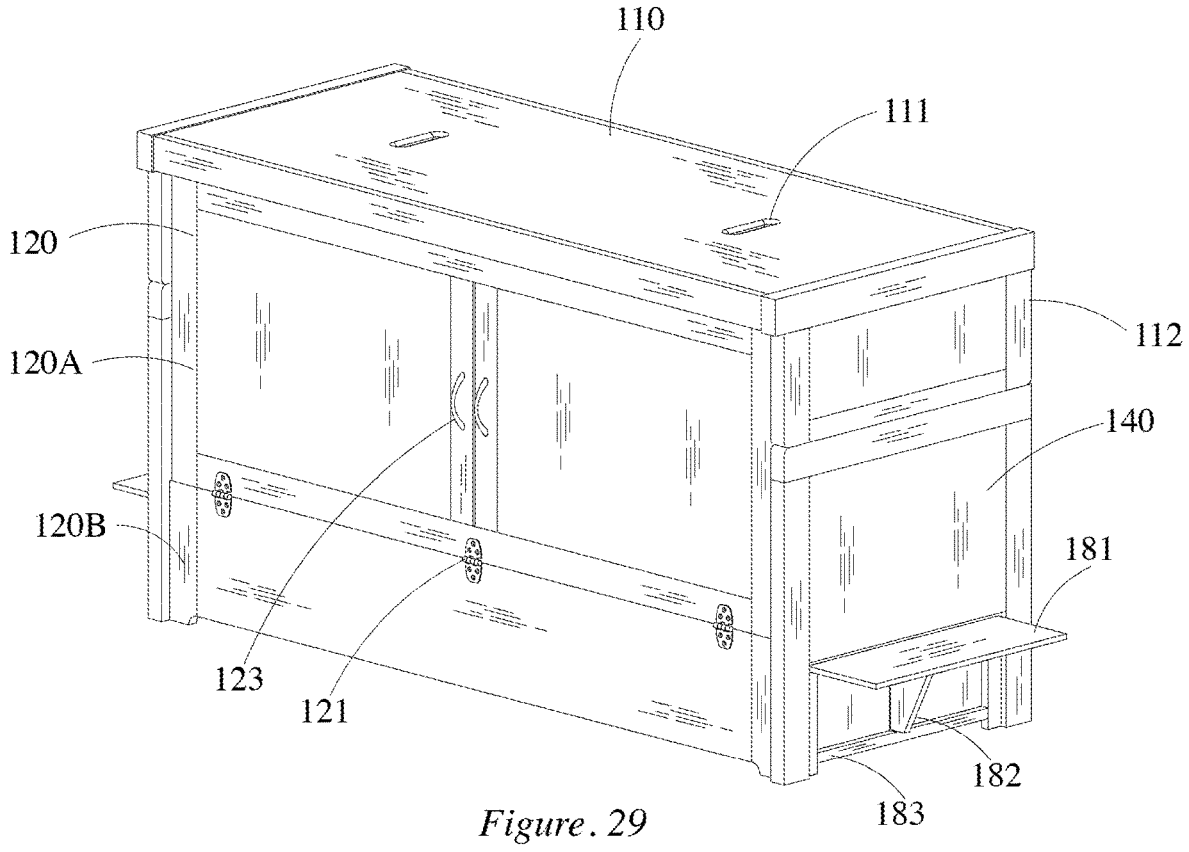
Figure 30:
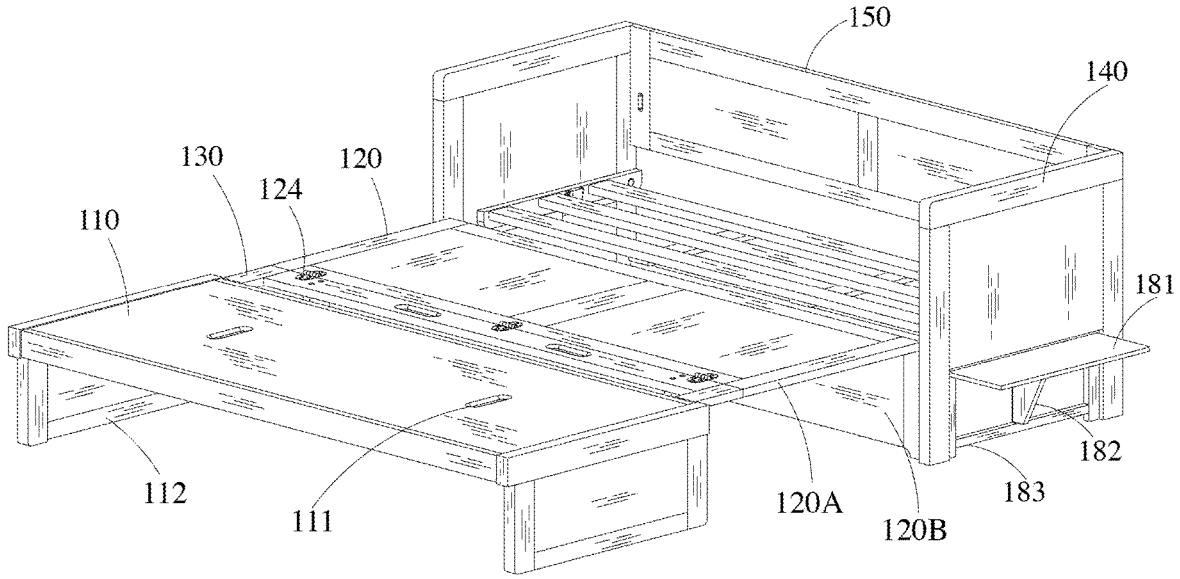
Figure 31:
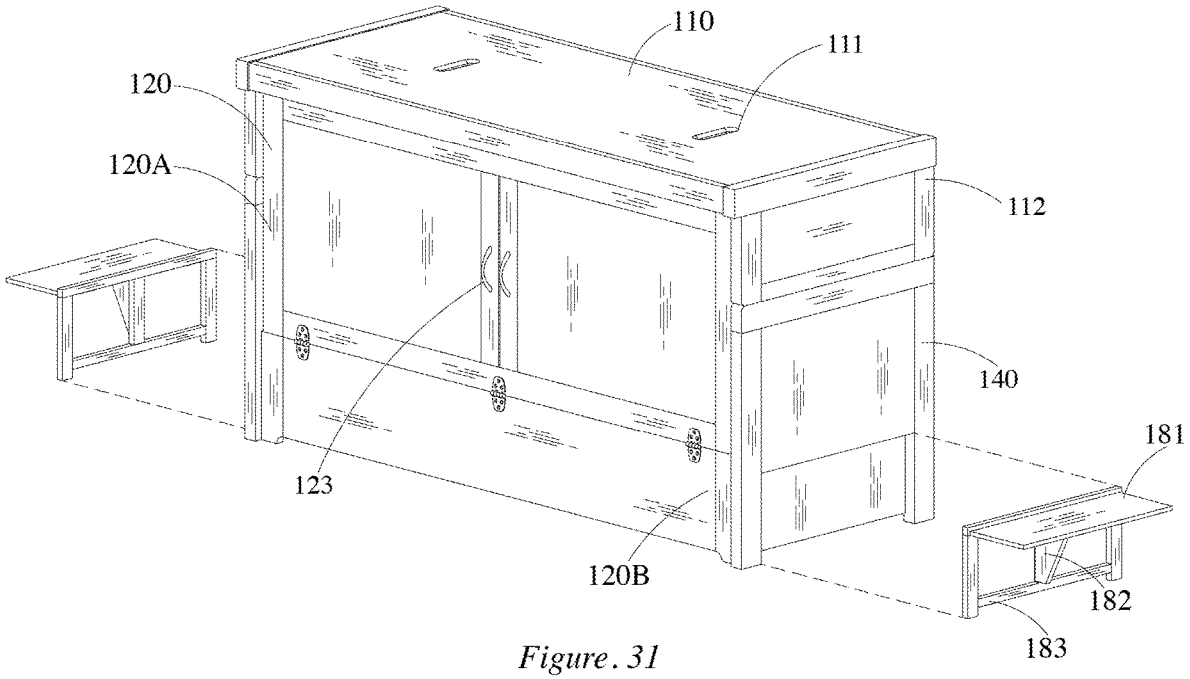
Figure 32:
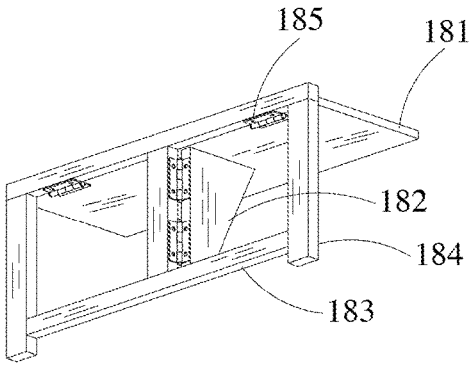
Figure 33:
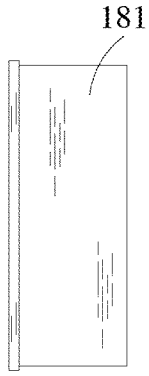
Figure 34:
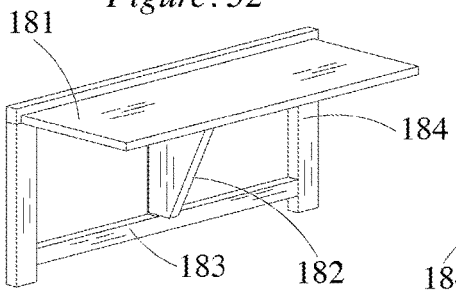
Figure 35:
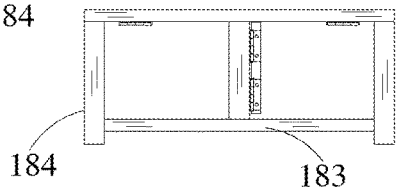
Figure 36:
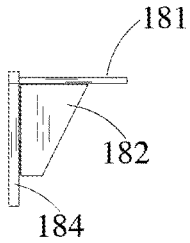
Figure 37:
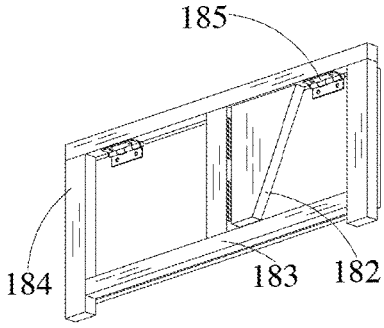
Figure 38:
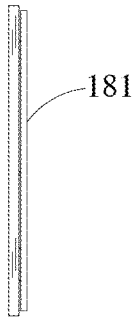
Figure 39:
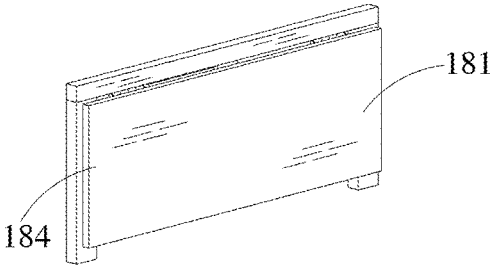
Figure 40:
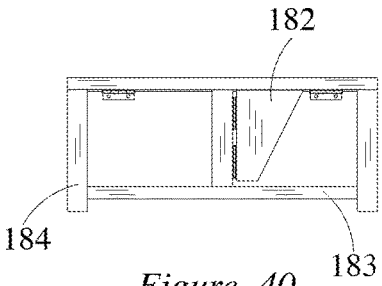
Figure 41:
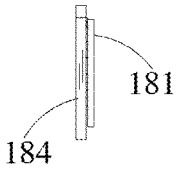
Figure 42:
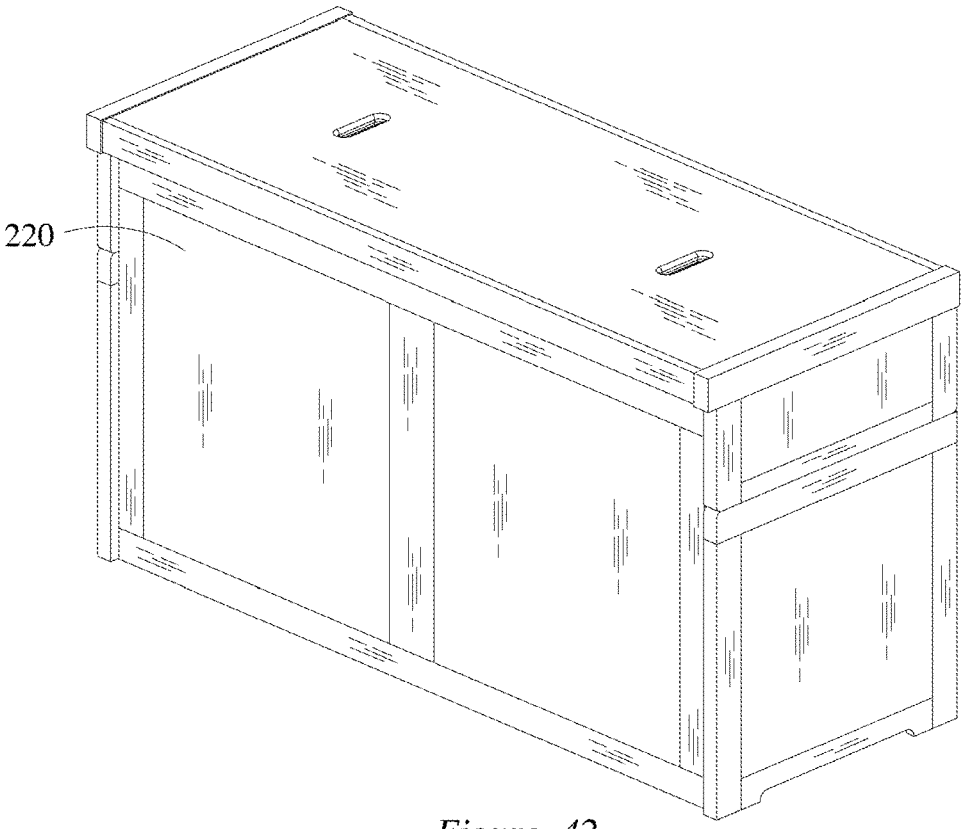
FIGS. 42 to 63 illustrate a chest according to some other example embodiments.
Figure 43:
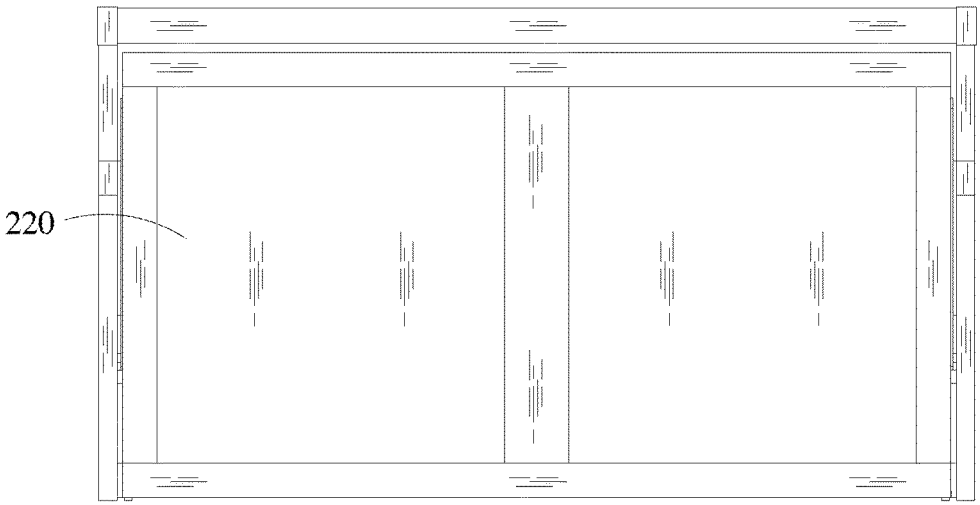
Figure 44:
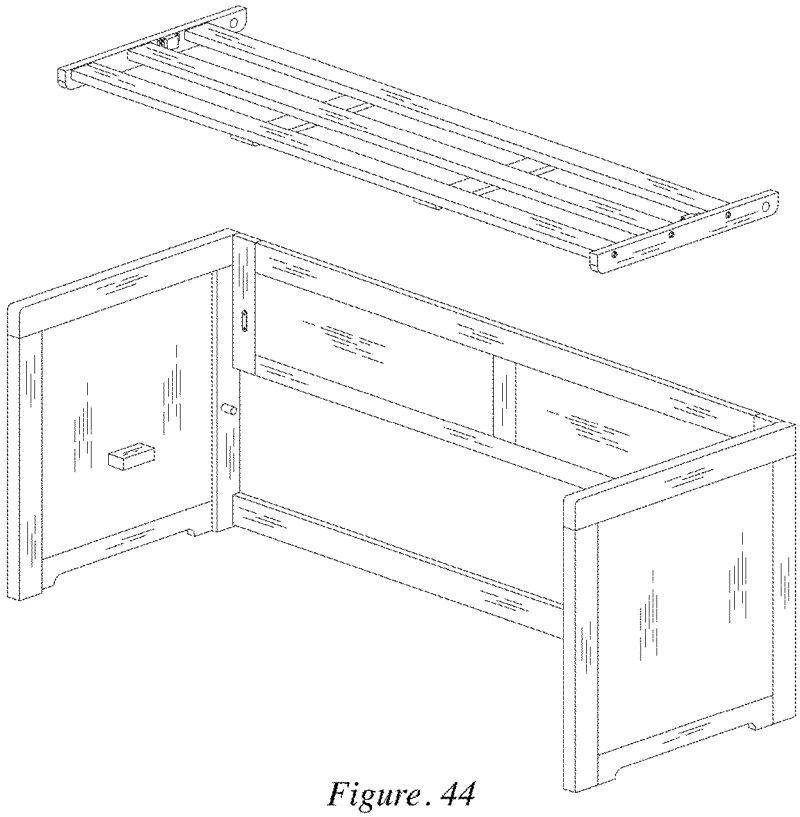
Figure 45:
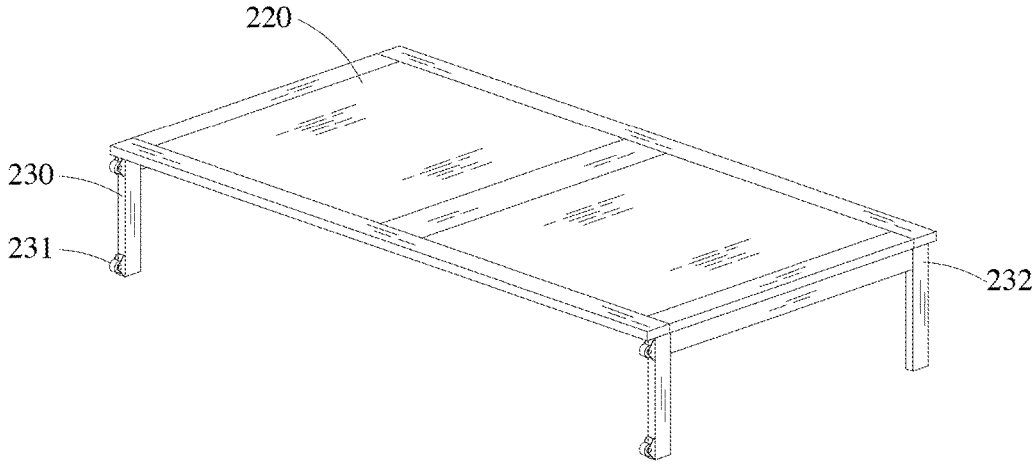
Figure 46:
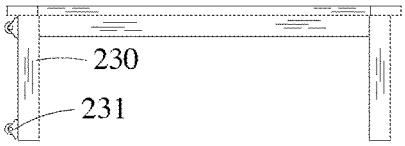
Figure 47:
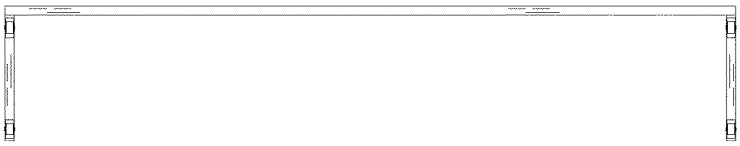
Figure 48:
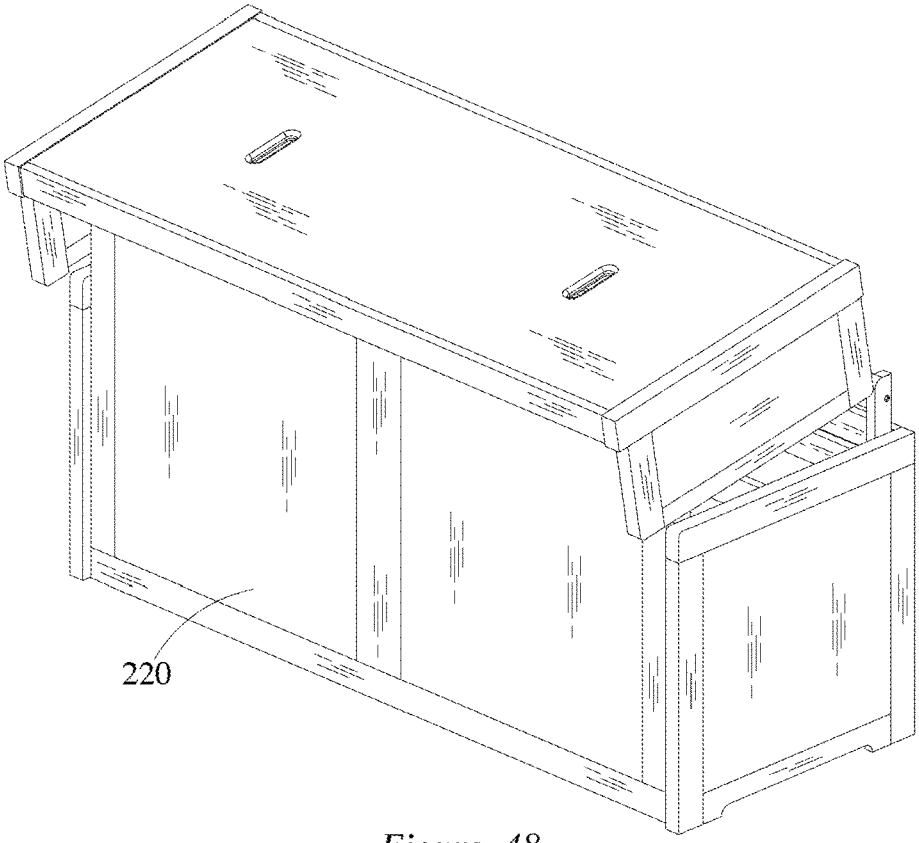
Figure 49:
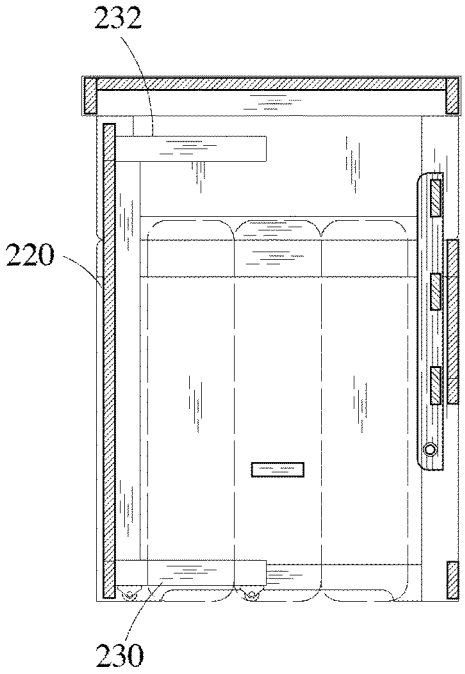
Figure 50:
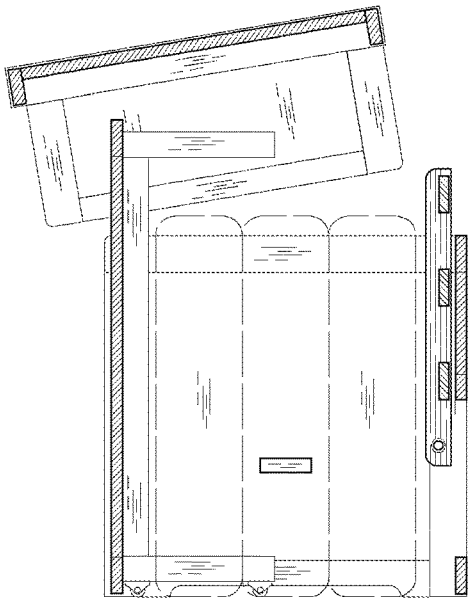
Figure 51:
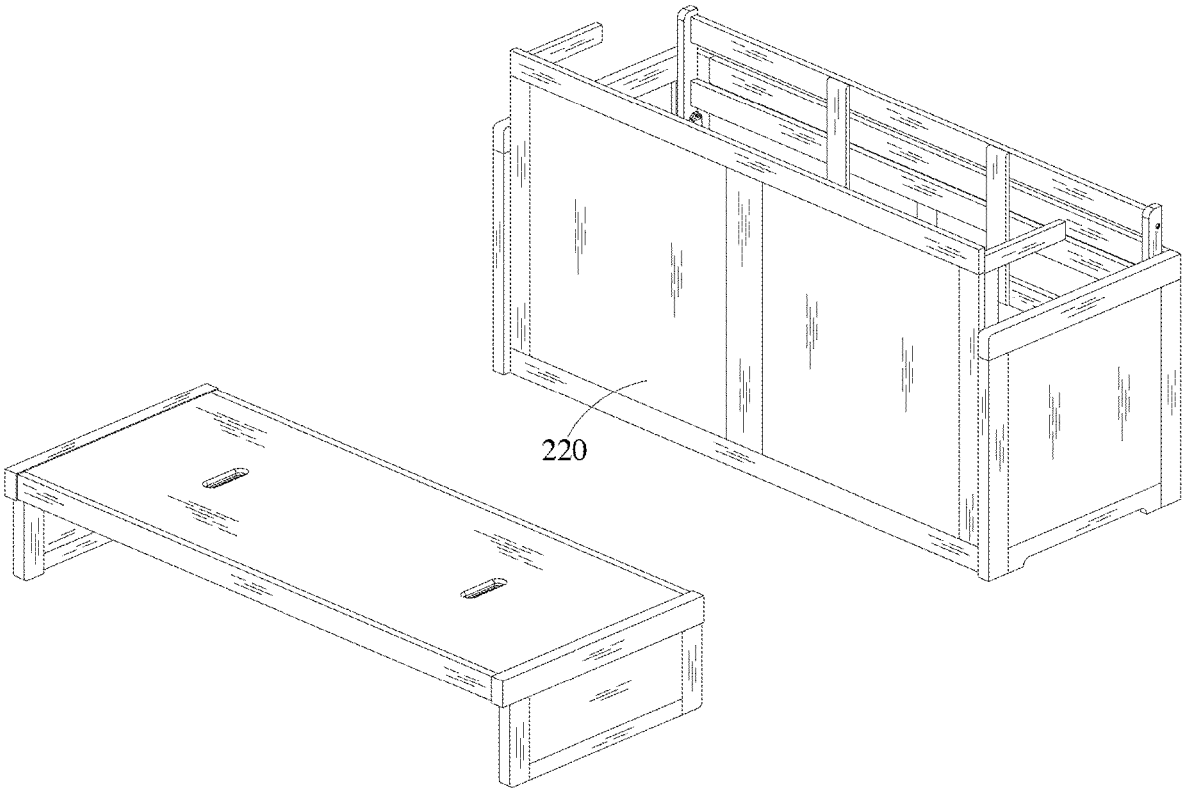
Figure 52:
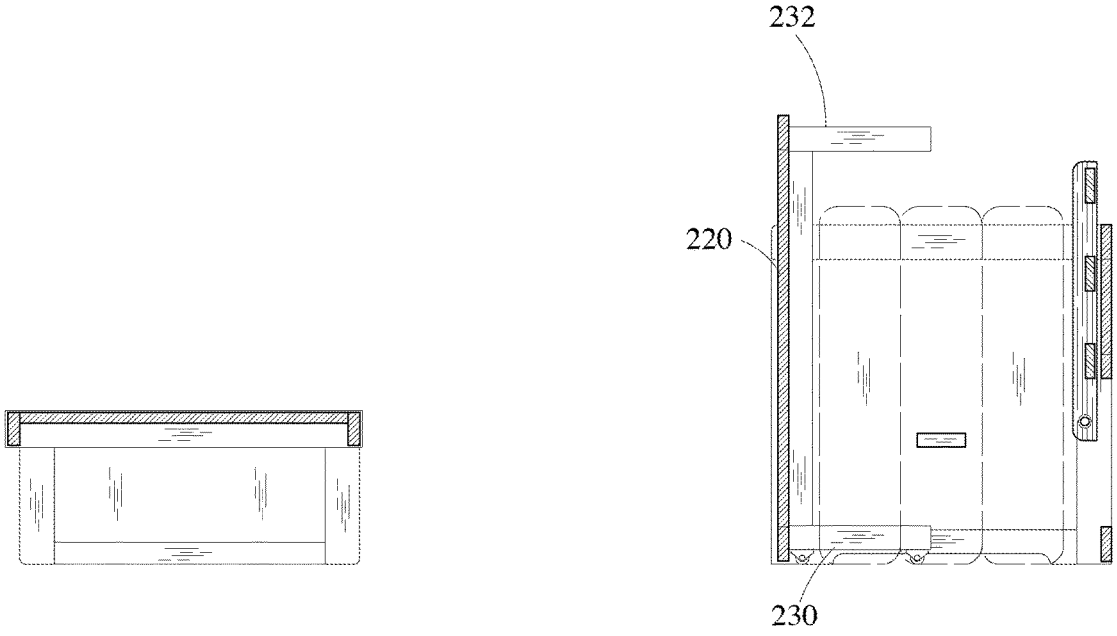
Figure 53:
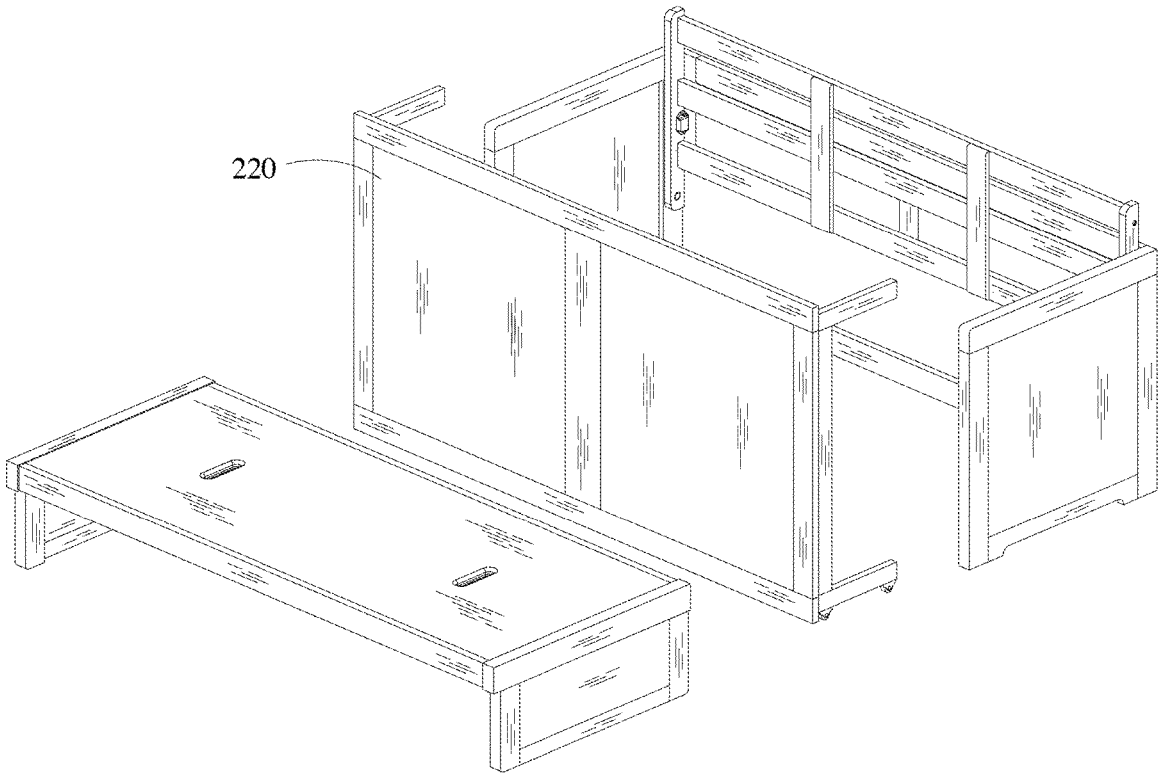
Figure 54:
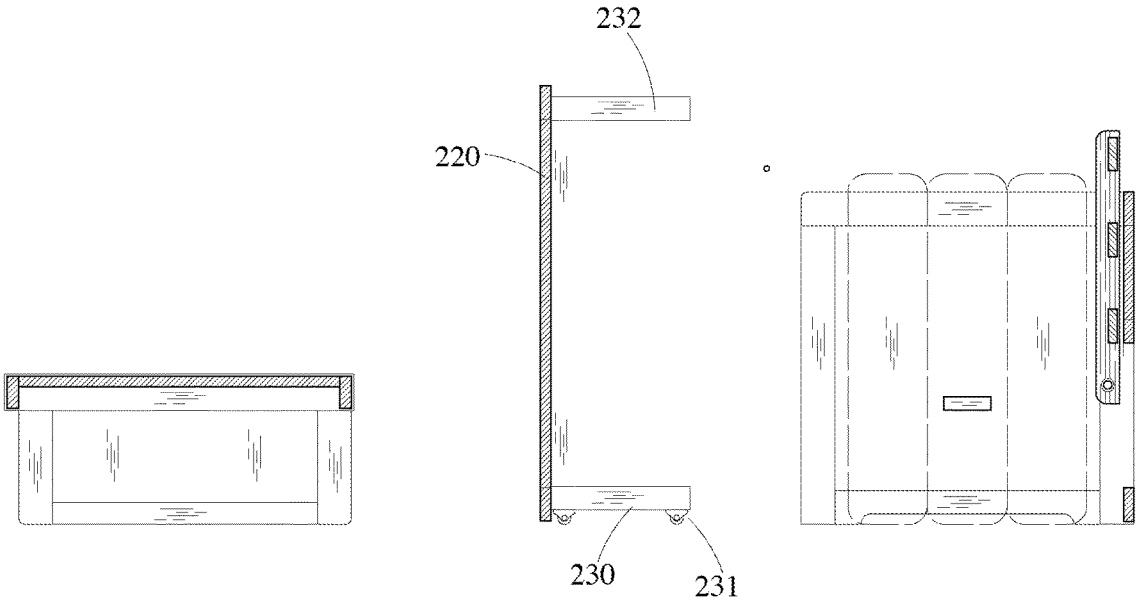
Figure 55:
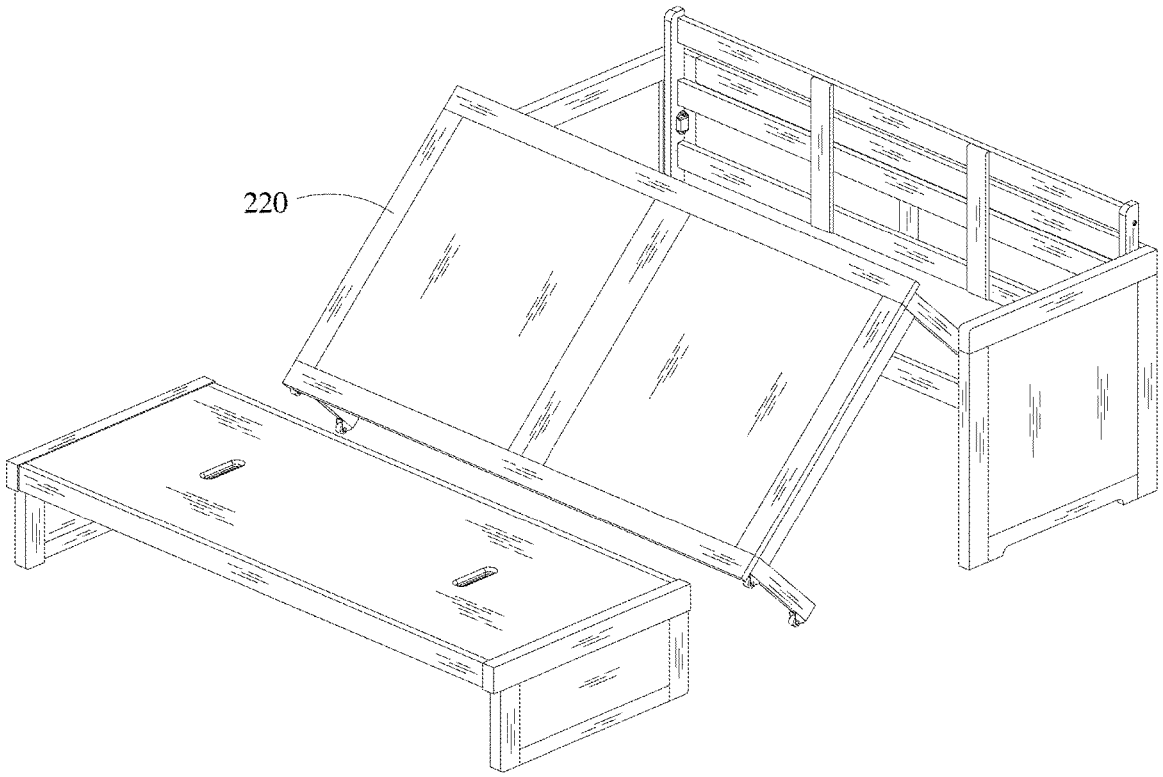
Figure 56:
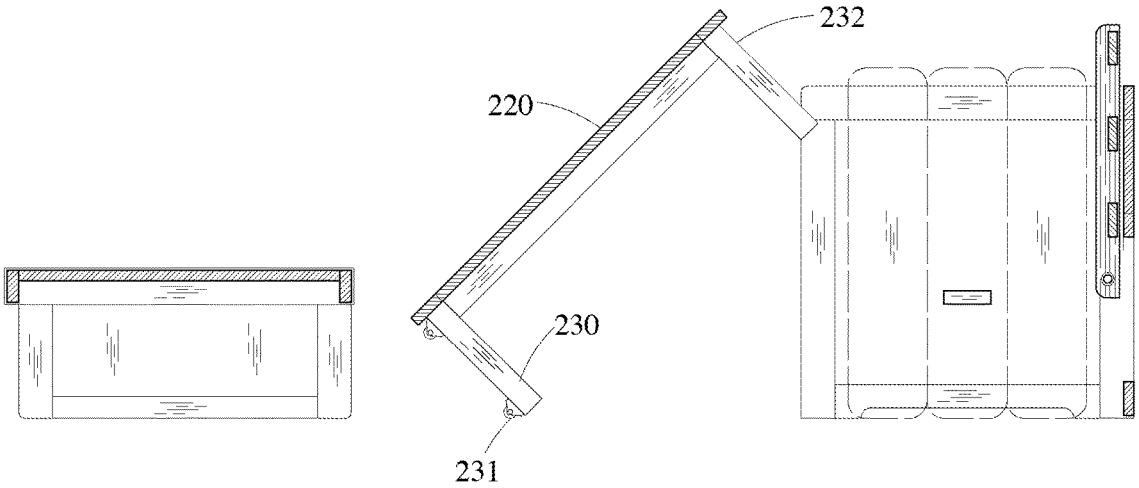
Figure 57:
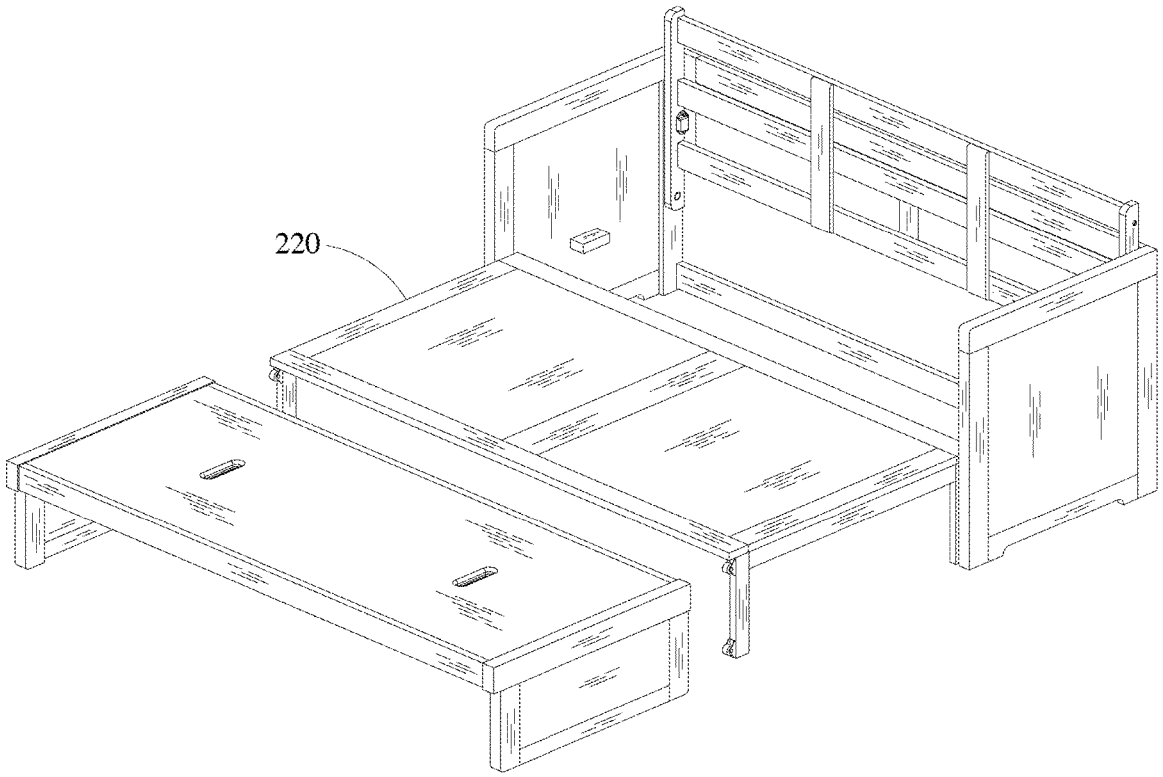
Figure 58:
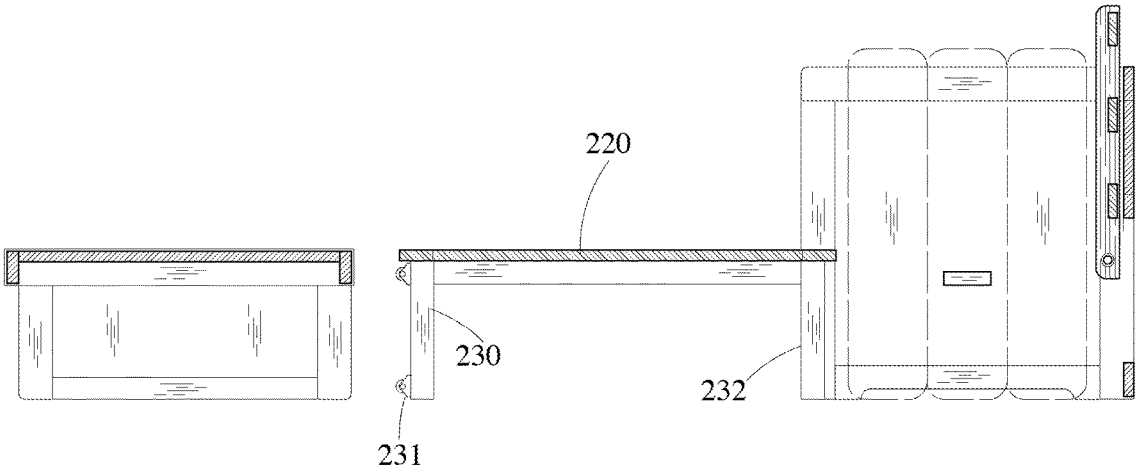
Figure 59:
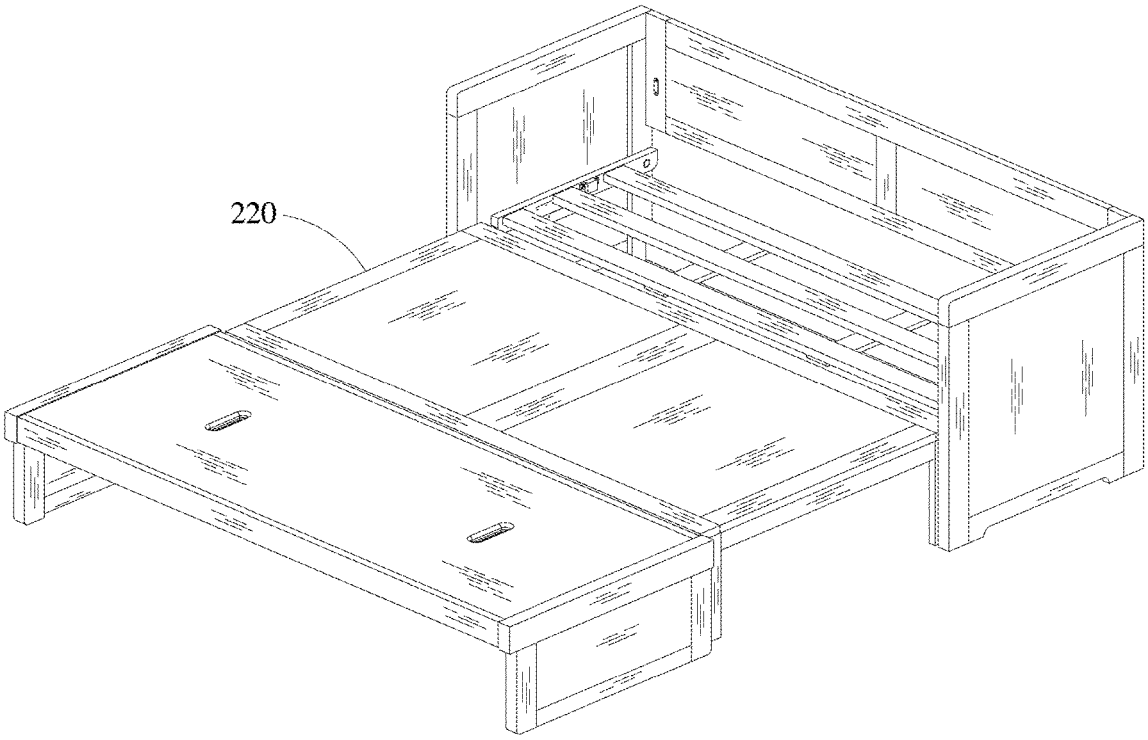
Figure 60:
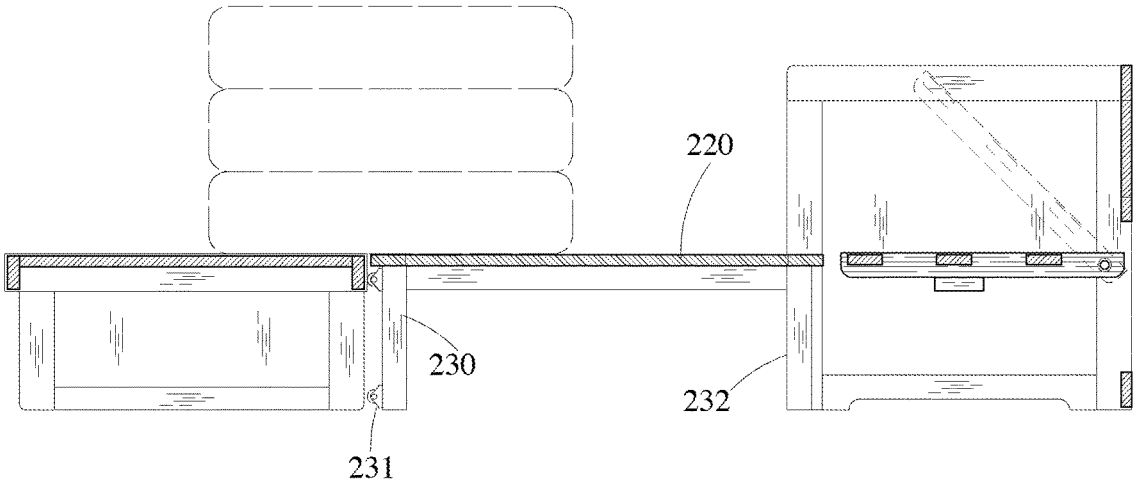
Figure 61:
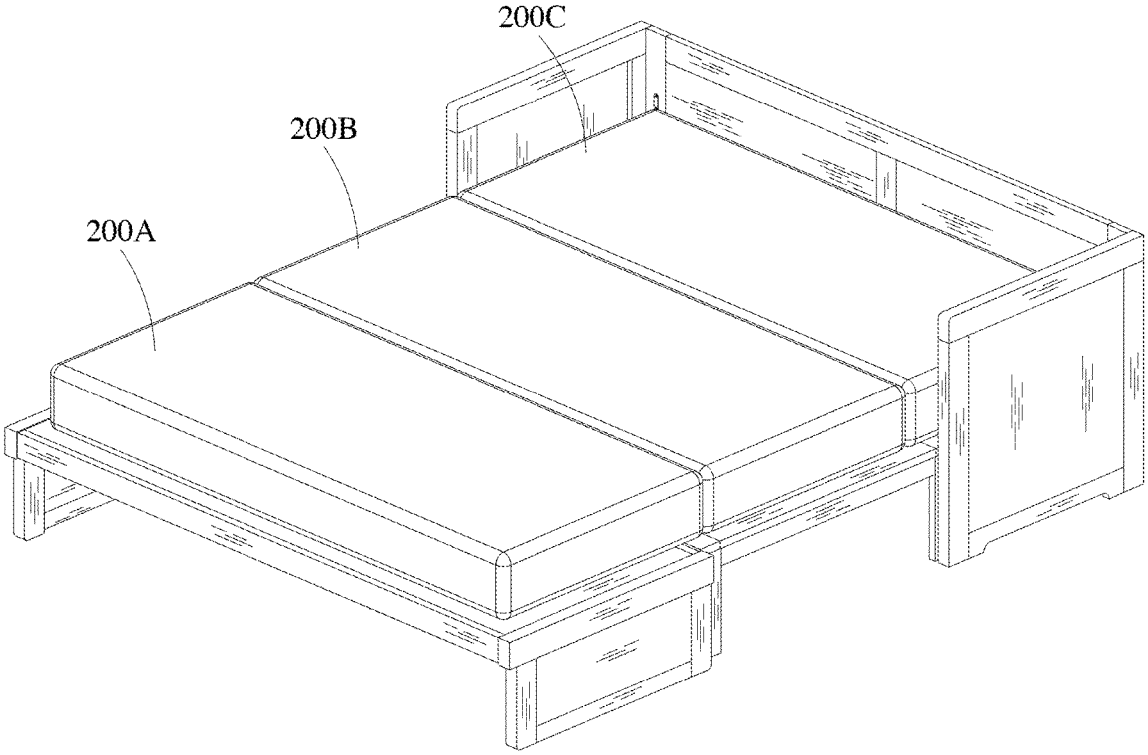
Figure 62:
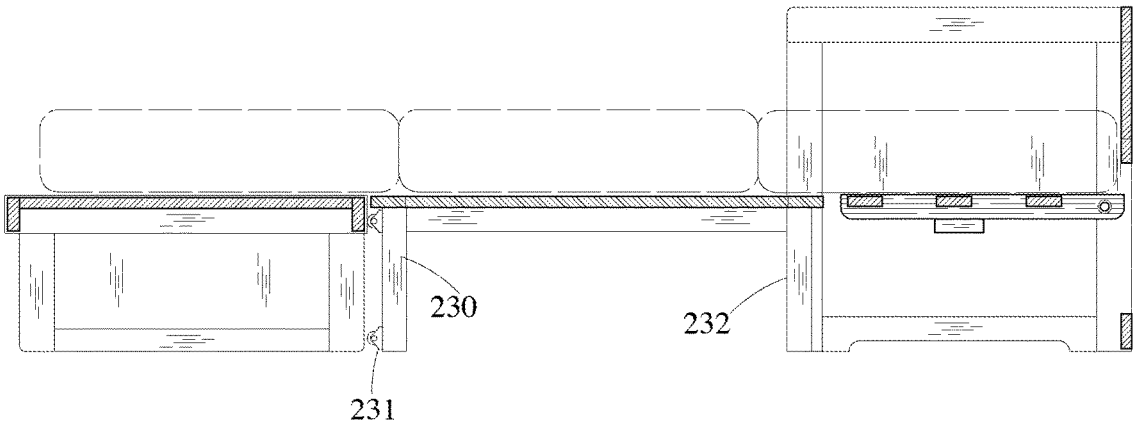
Figure 63:
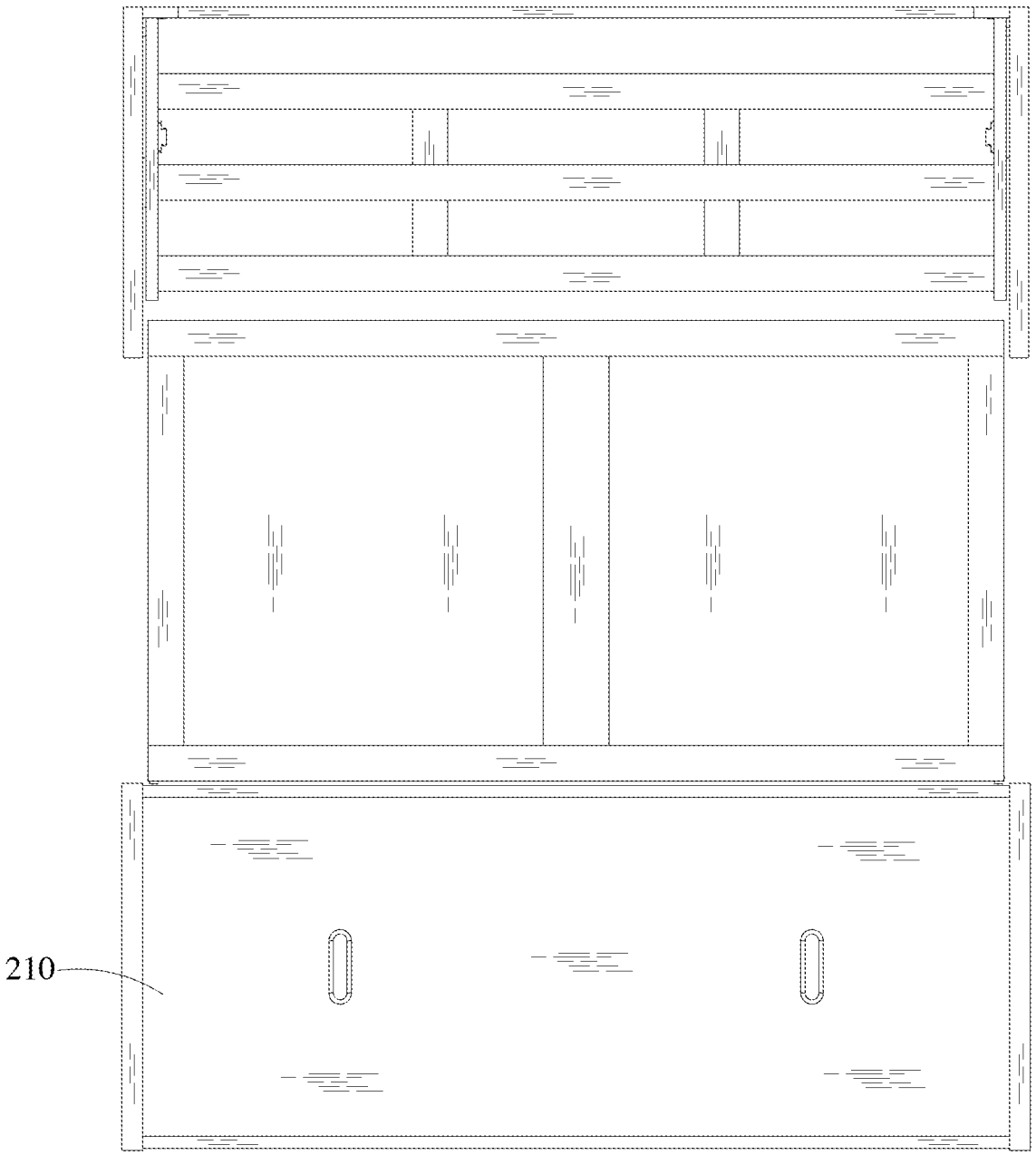
Figure 64:
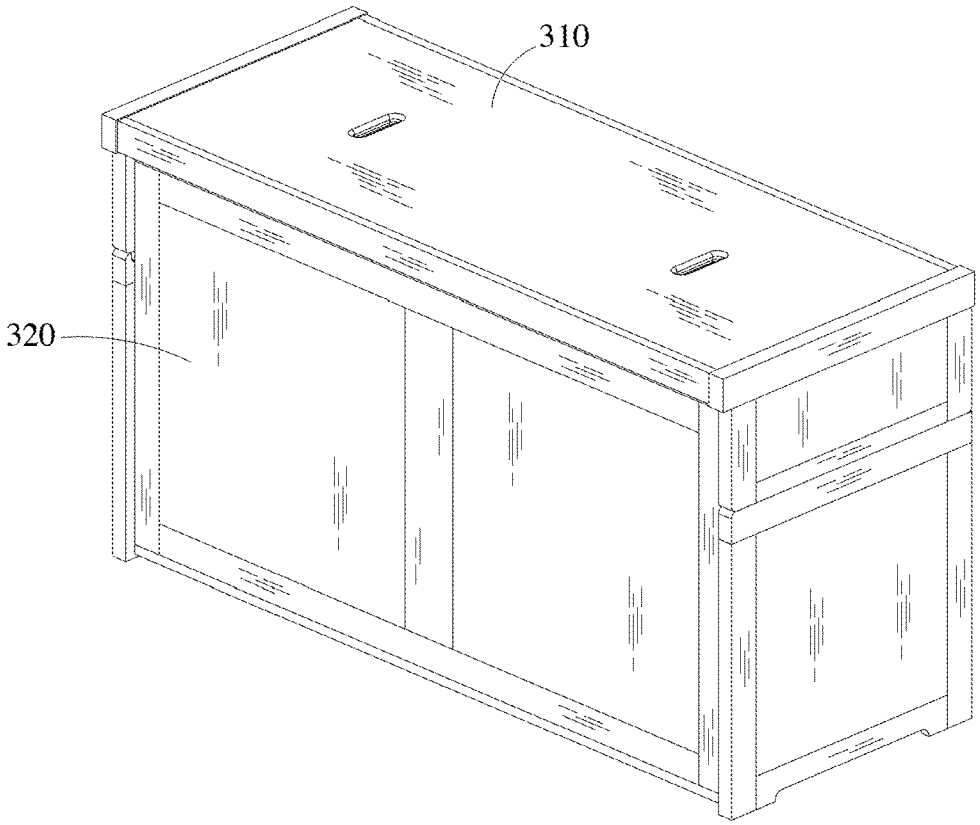
FIGS. 64 to 84 illustrate a chest according to some other example embodiments.
Figure 65:
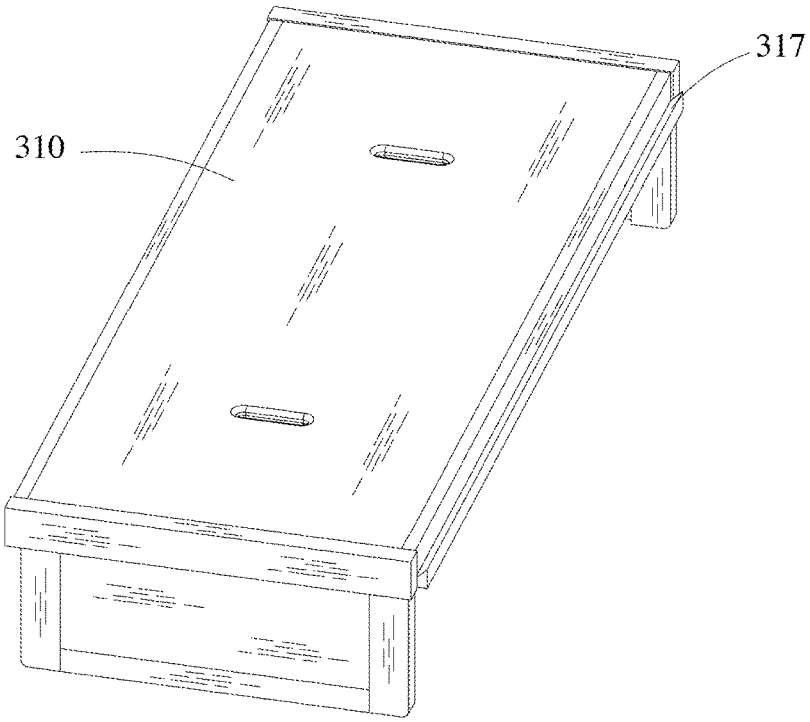
Figure 66:
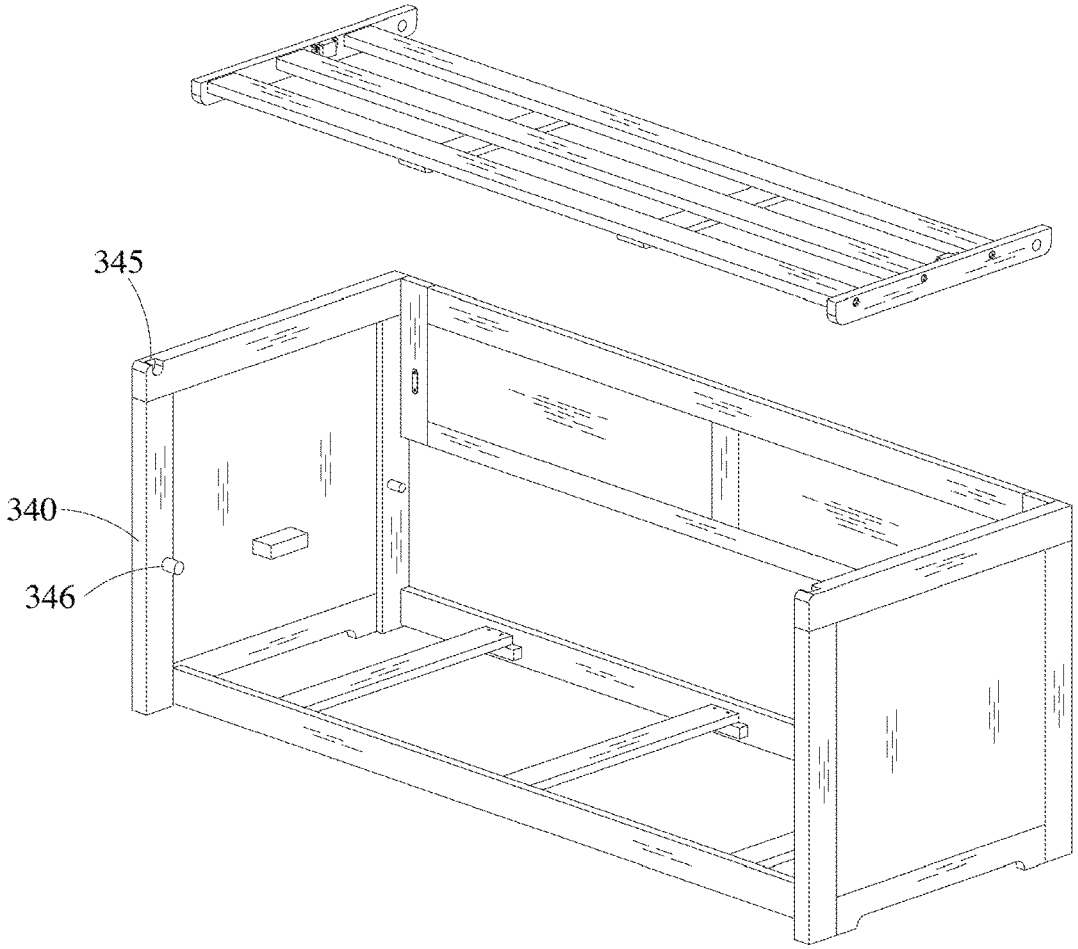
Figure 67:
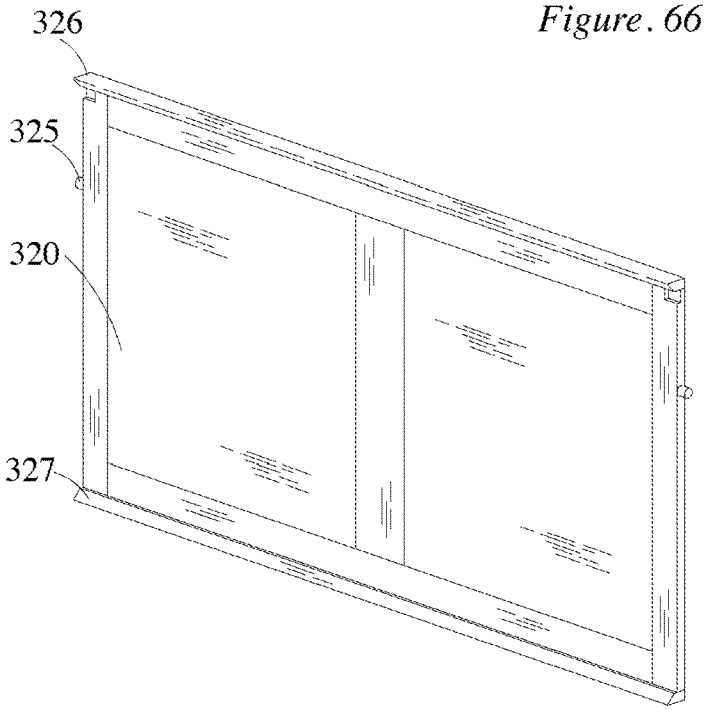
Figure 68:
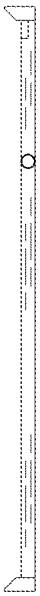
Figure 69:
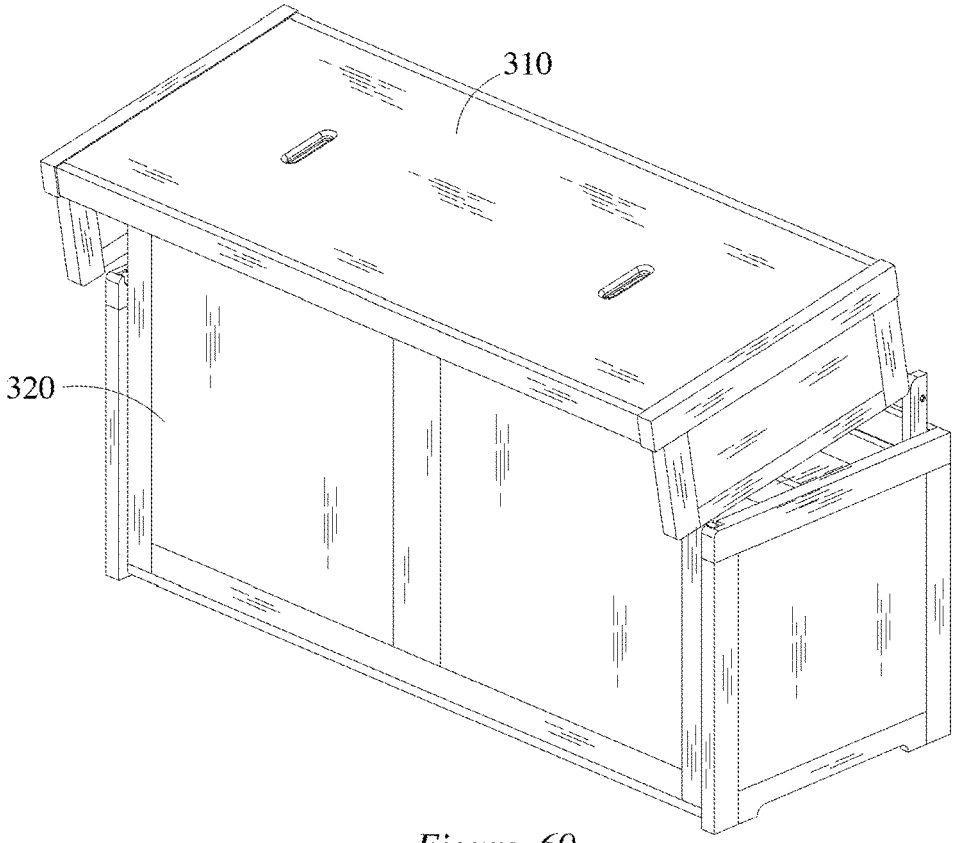
Figure 70:
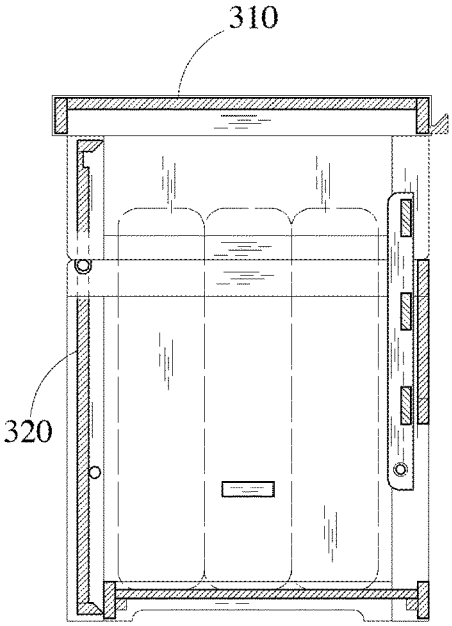
Figure 71:
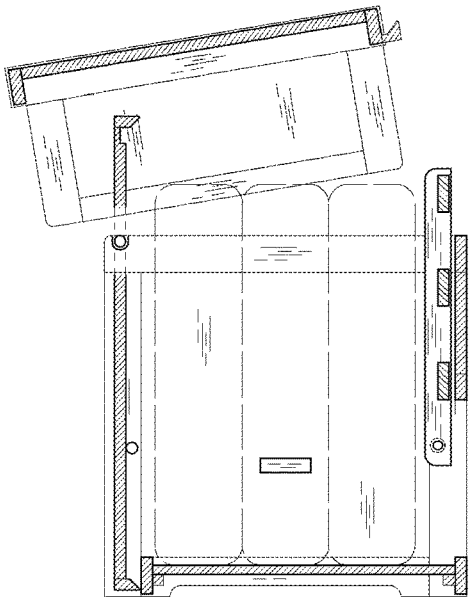
Figure 72:
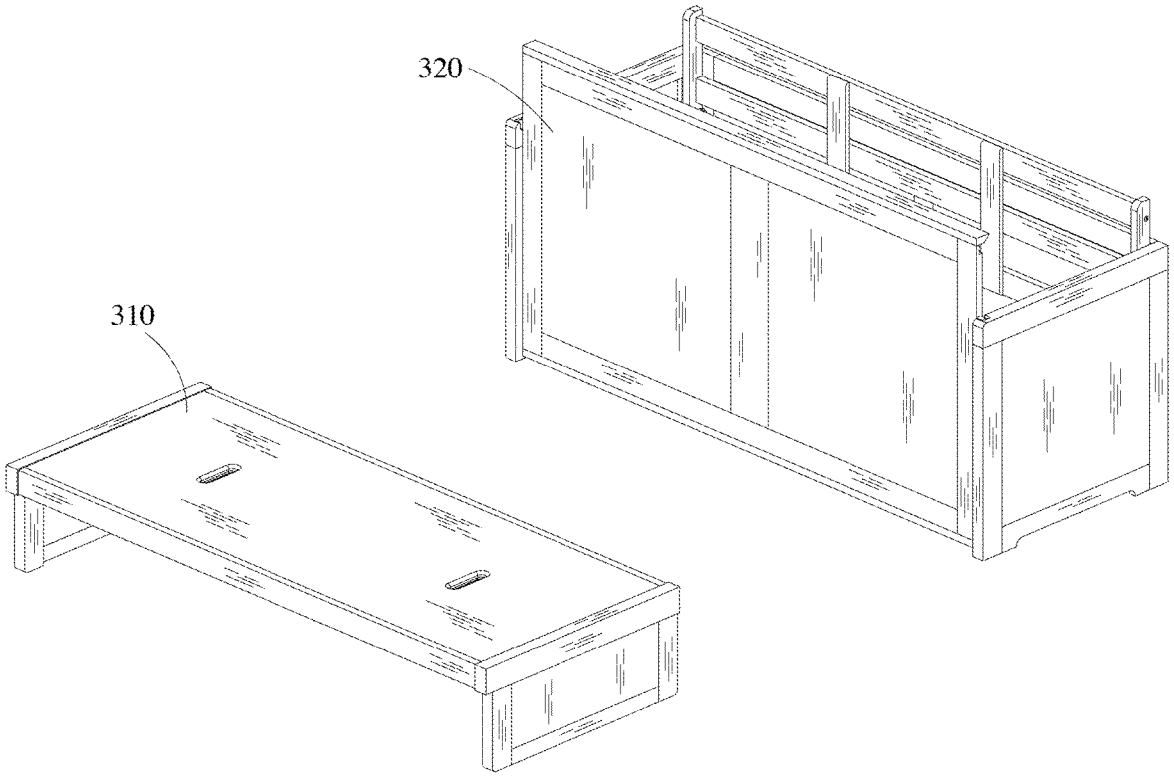
Figure 73:
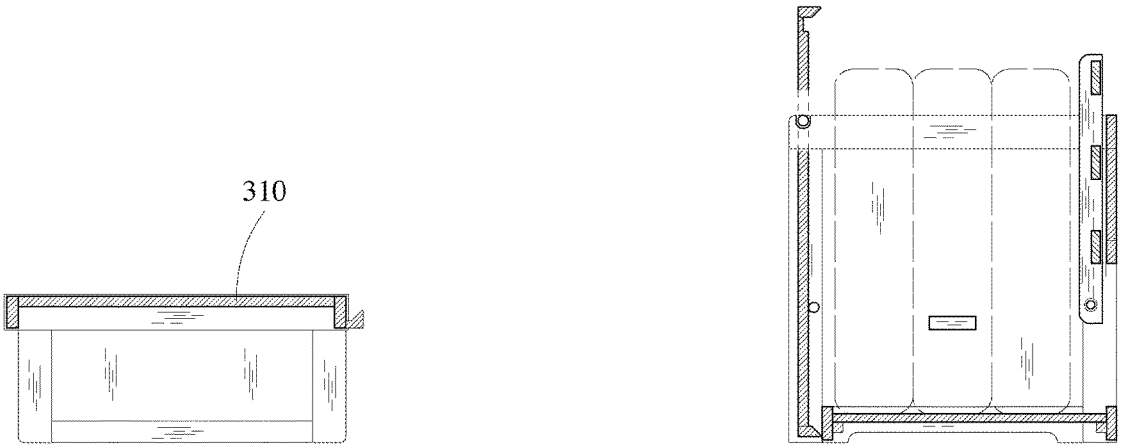
Figure 74:
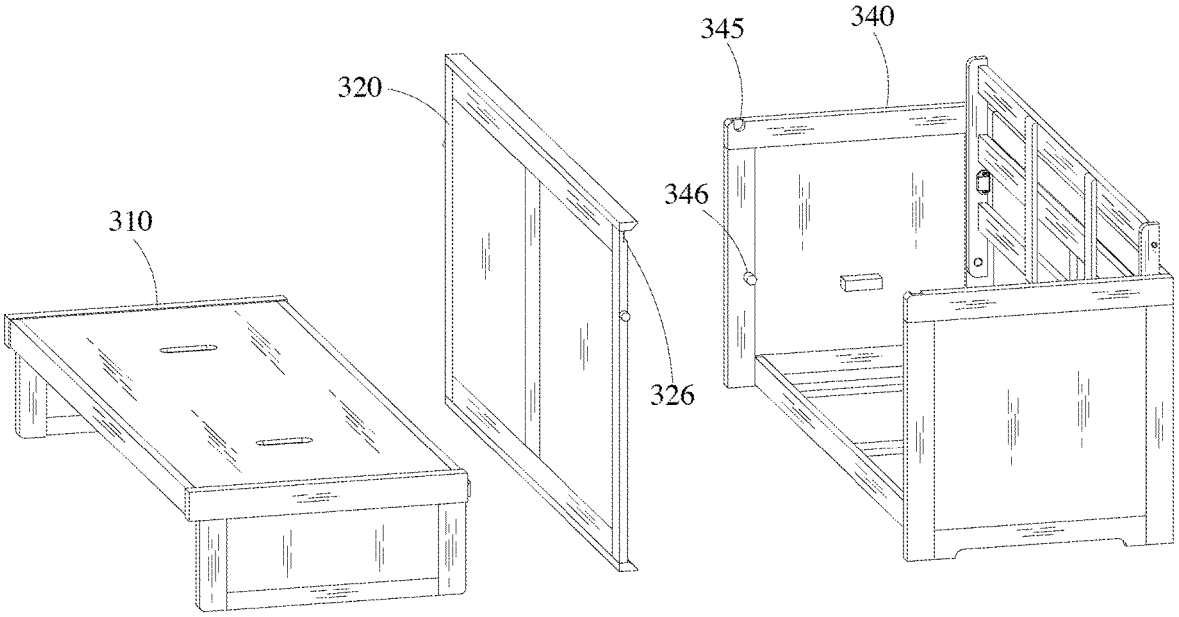
Figure 75:
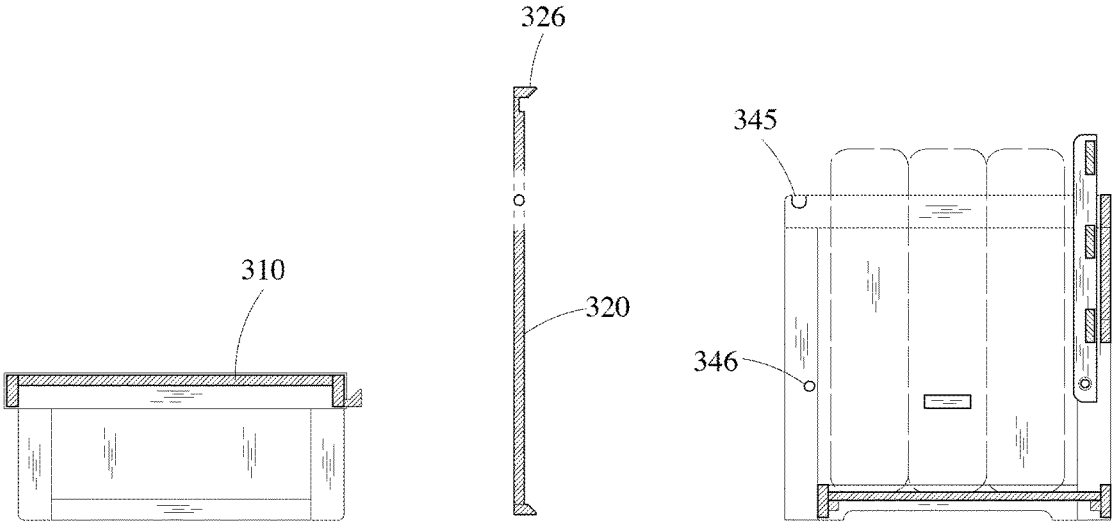
Figure 76:
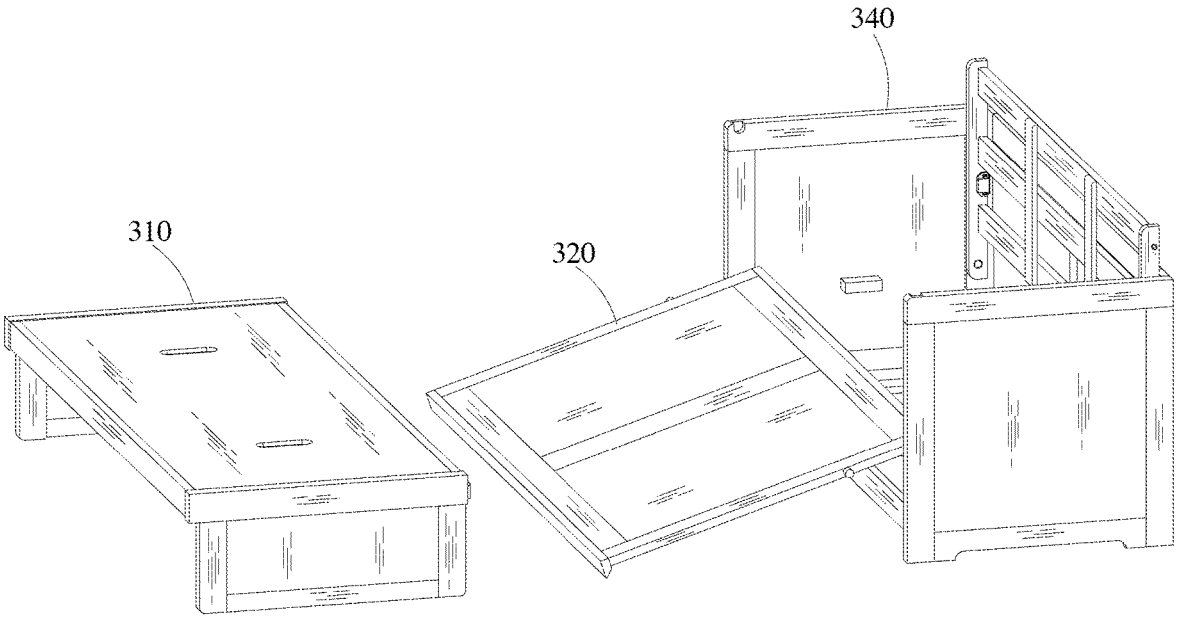
Figure 77:
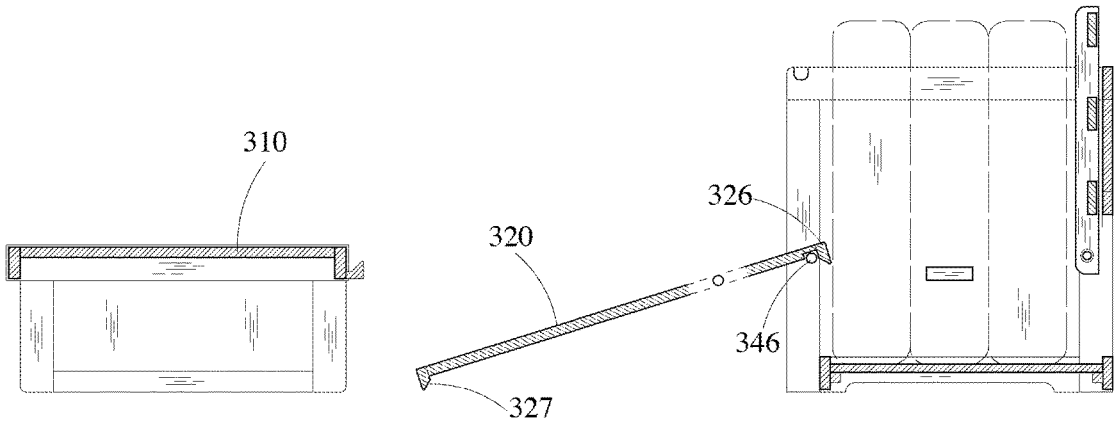
Figure 78:
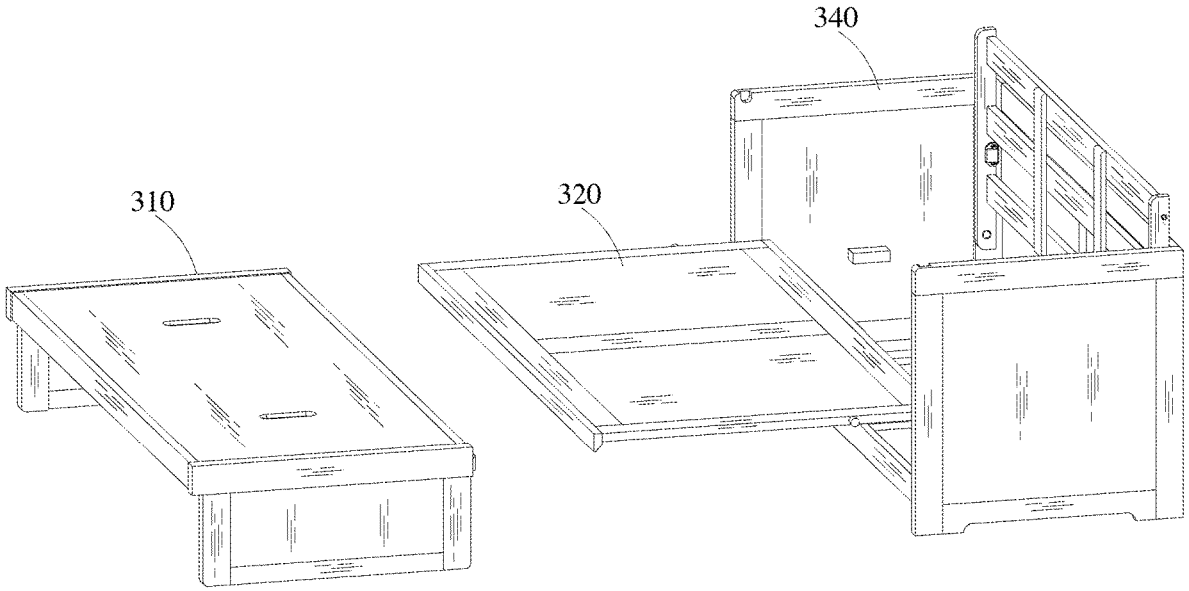
Figure 79:
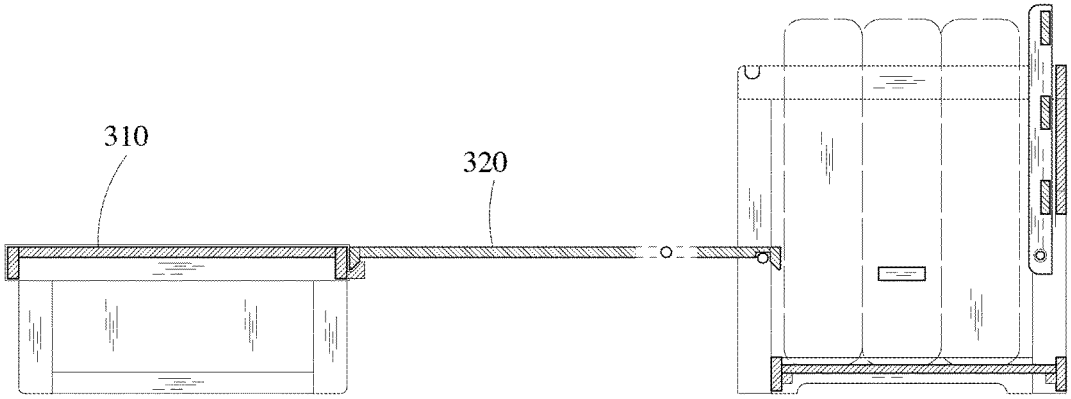
Figure 80:
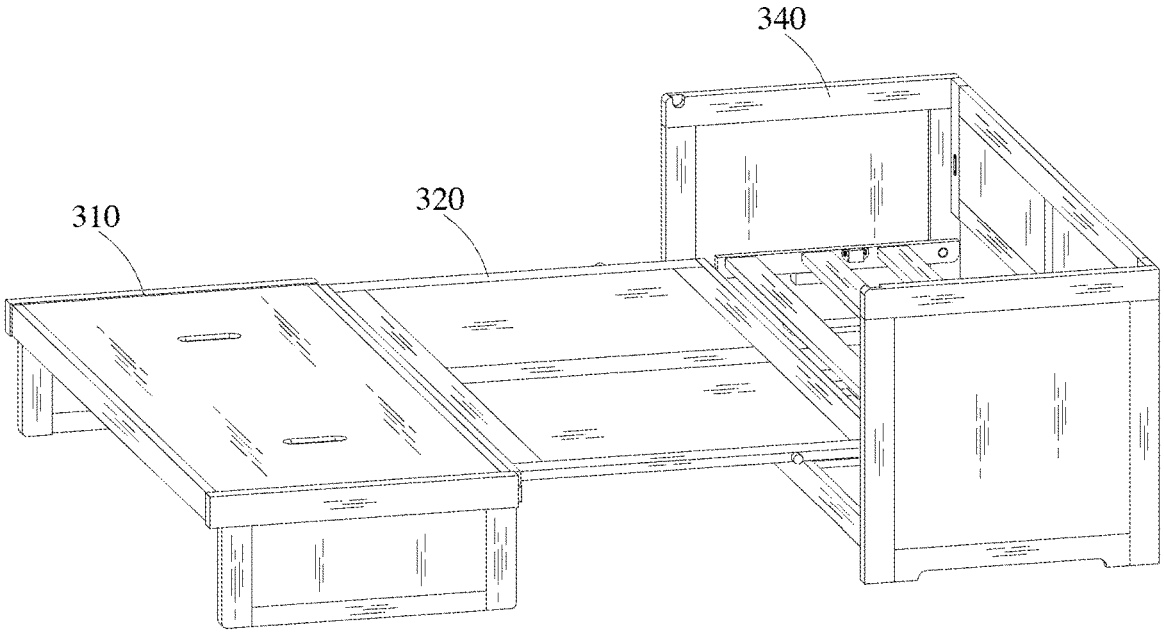
Figure 81:
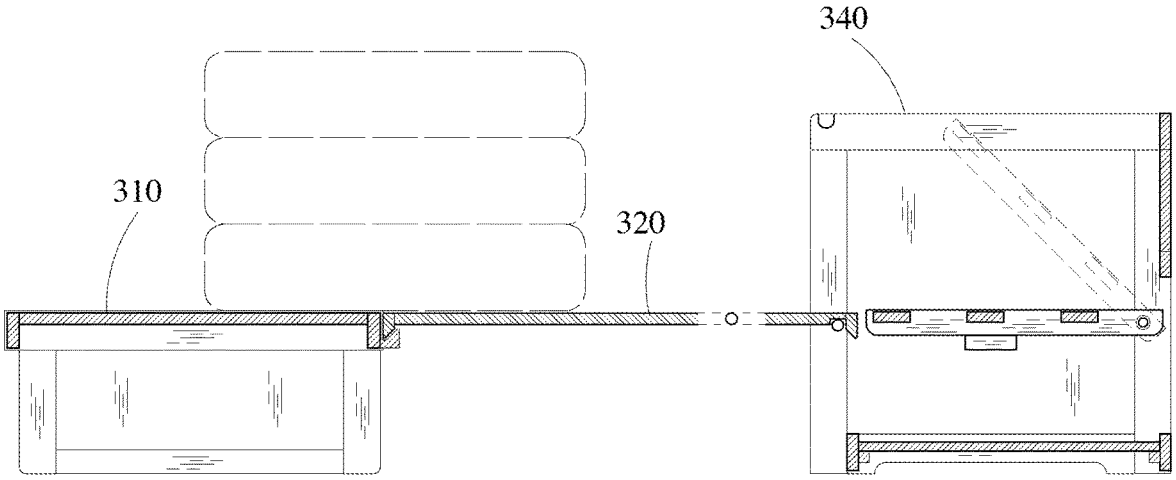
Figure 82:
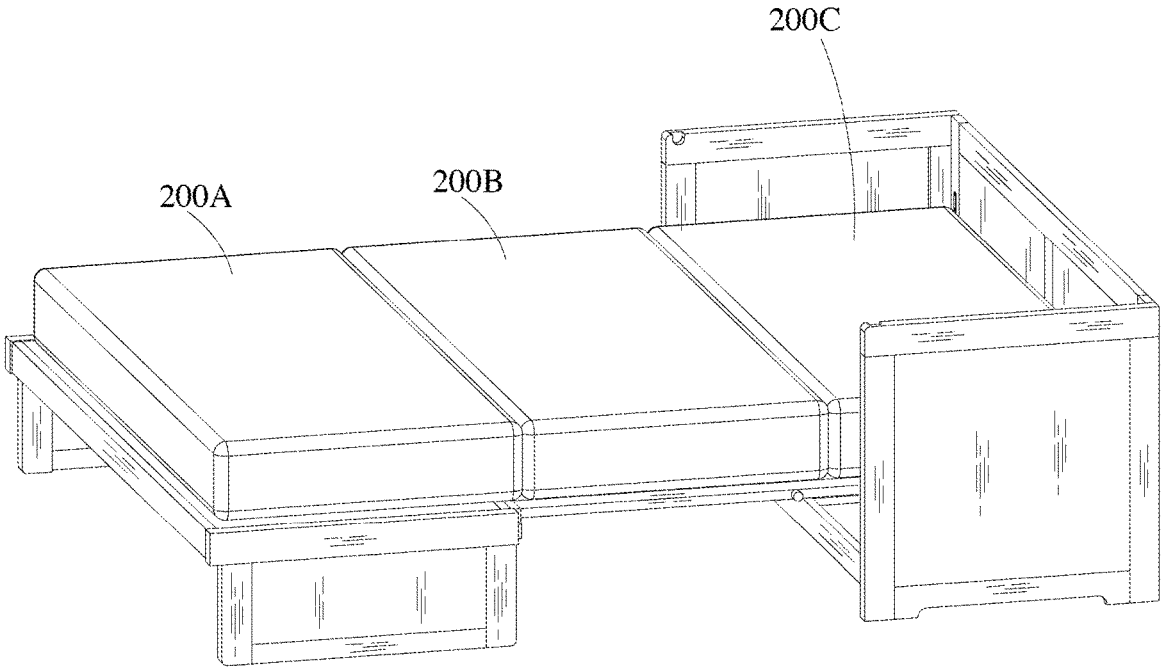
Figure 83:
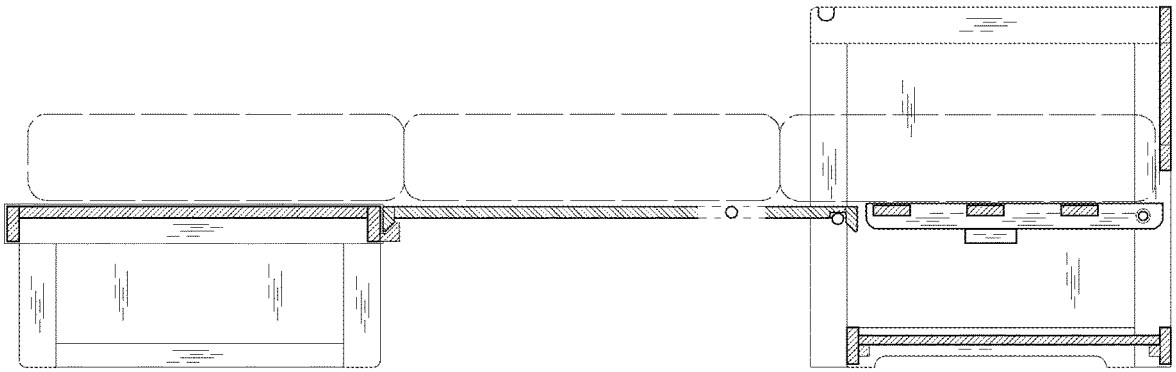
Figure 84:
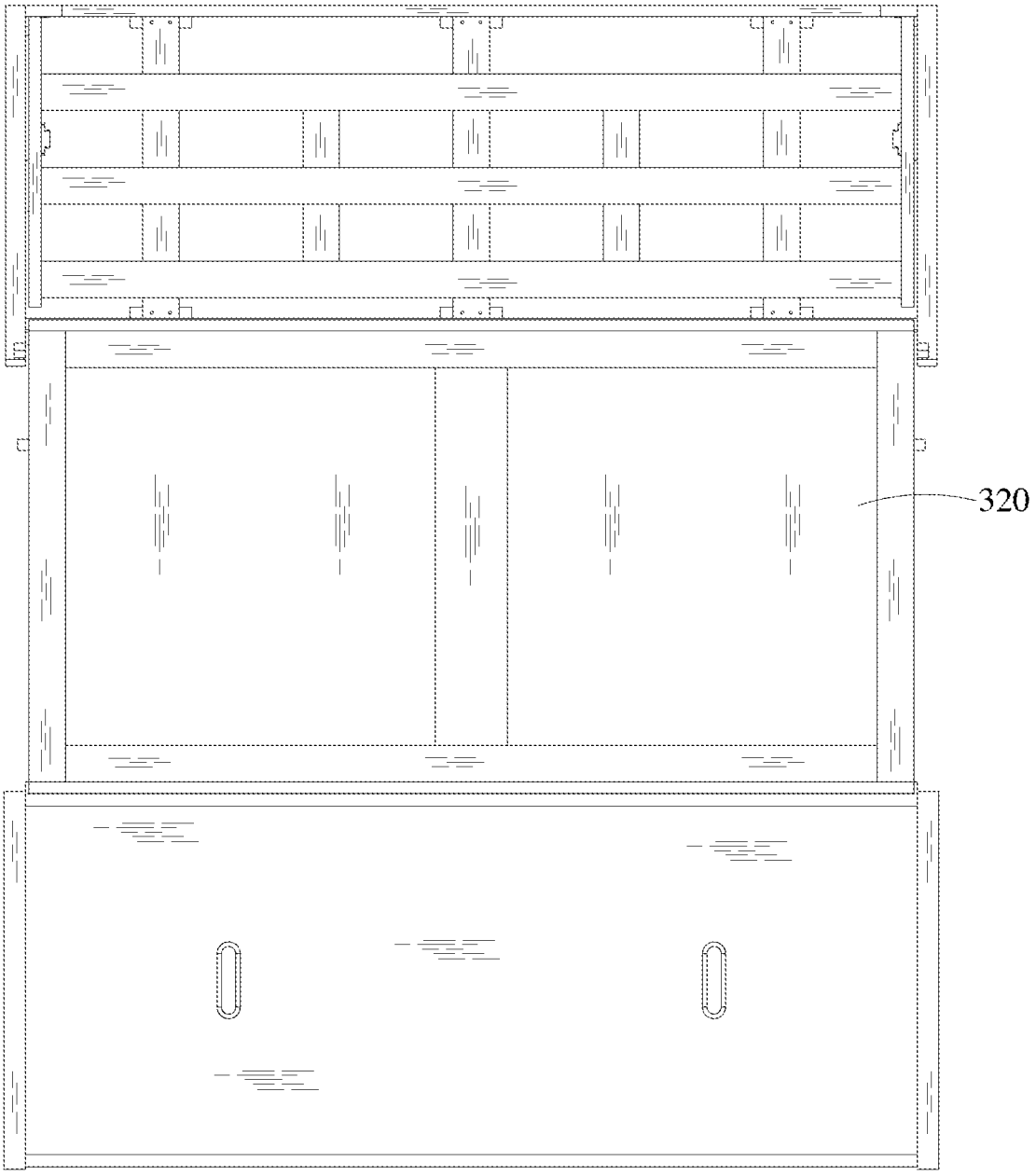

Lastly, as illustrated in FIGS. 24 and 25, the mattress 200 may be unfolded such that lower, middle and upper portions 200A-200C of the mattress is supported by the lower, middle and upper portions of the sleeping platform, respectively.

As discussed above, the sleeping platform may be formed simply and without the costs associated with telescoping rails by having the top panel 110 manually removable from enclosure by simply lifting the same and placing the top panel 110 on the floor to form the lower sleeping platform, folding the upper front panel 120A down and the folding leg assembly 130 out to form the middle sleeping platform, and lowering the folding slat deck 160 onto the supports 141 to form the upper sleeping platform. Further, by having the folding slat deck 160 pivotable between the folded position and the unfolded position, the height of the chest 100 may be reduced by allowing the mattress 200 to sit substantially deeper in the enclosure until needed.

FIGS. 28 to 41 illustrate a chest according to some other example embodiments.

Referring to FIGS. 28 to 41, in some other example embodiments, the chest 100 may include side panels 140' that include a lift tray 180 (also referred to as a nightstand 180) attached thereto. The lift tray 180 may be attached to one of the side panels 140' or both of the side panels 140'.

The lift tray 180 may include a foldable shelf 181, a foldable leg 182, a support 183, and crossbars 184, the foldable shelf 181 and foldable leg 182 may be connected to a body of the lift tray 180 via one or more hinges 185. To setup the nightstand 180, the operator may raise the shelf 181 perpendicular to the side panel 140', and move the foldable leg 182 from a folded position to the unfolded positon to support the weight of the shelf 181 and items placed thereon. When not in use, the nightstand 180 may be collapsed by the operator moving the foldable leg 18 to the folded positon and lowering the shelf 181 parallel with the side panel 140'.

In some example embodiments, the lift tray 180 may be a separate module that may be optionally purchased and installed on the chest 100. However, example embodiments are not limited thereto, and in other example embodiments, the lift tray 180 may be manufactured with the chest 100.

FIGS. 42 to 63 illustrate a chest according to some other example embodiments.

Referring to FIGS. 42 to 63, a chest 200 may include a roll-out front panel 220 that includes a front leg assembly 230 and a rear leg assembly 232 that are rigidly connected to the roll-out front panel 220. The front leg assembly 230 may include rollers 231 that allow the roll out-front panel 230 to roll on the floor.

The chest 200 may also include the top panel 110, front panel 120, side panels 140, back panel 150, folding slat deck 160, and bottom slats 170 that are identical to the description of the same with regard to the chest 100. However, for the sake of brevity repeated description is omitted herein.

When the roll-out front panel 220 is in the upward position, the rear leg assembly 232 may extend within the enclosure in a direction parallel to the floor, and the lower leg assembly 230 may rest on the floor via the rollers 231.

As illustrated in FIGS. 51 to 56, the roll-out front panel 220 may transition between the upward positon and the downward position by simply rolling the roll-out front panel 220 away from the chest 100 after the top panel is lifted off of the chest, and then tipping over the roll-out front panel 220 such that each of the front leg assembly 230 and rear leg assembly 232 rest on the floor to form the middle sleeping platform.

The chest 200 including the roll-out front panel 220 may have increased production efficiency as compared to the chest 100 that includes the hinged front panel 120.

FIGS. 64 to 84 illustrate a chest according to some other example embodiments.

Referring to FIGS. 64 to 84, a chest 300 may include top panel 310, a hook-on front panel 320 and side panels 340.

The top panel 310 may include a clawed edge 317, the hook-on front panel 320 may include protrusions 325 and clawed edges 326, 327, and each of the side panels 340 may include a divot 345 and a protrusion 346 on the front side of the side panels 340.

In the closed position, as illustrated in FIGS. 64 to 73, the front panel 320 may be attached to the side panels 340 via a respective one of the protrusions 325 on the front panel 320 being caught in respective ones of the divots 345 on the side panels 320.

In the open position, as illustrated in FIGS. 74 to 84, the front panel 320 may rest parallel with and suspended from the floor by having one end of the front panel 320 supported by the top panel 310 and the other end of the front panel 320 supported by the side panels 340 to form the middle sleeping platform. For example, one of the clawed edges 326, 327 of the hook-on front panel 320 may be hooked onto the clawed edge of the top panel 310 and the other one of the clawed edge 326 of the hook-on front panel 320 may be hooked onto the protrusions 346 protruding from the side panels 340 to form the middle sleeping platform.

The chest 300 including the hook-on front panel 320 may have increased production efficiency as compared to the chest 100 that includes the hinged front panel 120.

As discussed above, the sleeping platform may be formed simply and without the costs associated with telescoping rails by having the top panel manually removable from enclosure by simply lifting the same and placing the top panel on the floor to form the lower sleeping platform, form the middle sleeping platform from the front panel, and lowering the folding slat deck onto the supports to form the upper sleeping platform. Further, by having the folding slat deck pivotable between the folded position and the unfolded position, the height of the chest may be reduced by allowing the mattress to sit substantially deeper in the enclosure until needed. Additionally, the height of the chest may be further reduced while still including a sleeping platform long enough to accommodate a conventional mattress by including a folding leg assembly that is able to transition between the folded and unfolded states.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A chest configured to transition between an open position and a closed position, the chest including an enclosure configured to store a foldable mattress supported by a sleeping platform when the foldable mattress is in an unfolded state, the chest comprising:

a top panel, a front panel, and side panels, the top panel configured to rest on one or more of the side panels and the front panel without hinges connecting same when the chest is in the closed position, and to be manually lifted off of the chest to completely detach the top panel from the chest such that the top panel is freely movable in all directions relative to the chest and can be subsequently positionable to form a lower portion of the sleeping platform when the chest is in the open position while a top portion of the top panel remains oriented in a same direction as prior to detachment from the chest.

2. The chest of claim 1, wherein the top panel includes legs extending in a direction perpendicular to a top surface of the top panel such that the top surface and the legs are liftable as one unitary piece off of the chest.

3. The chest of claim 2, wherein the legs of the top panel are configured to support the lower portion of the sleeping platform.

4. The chest of claim 1, further comprising:

a folding slat deck within the enclosure, the folding slat deck configured to transition between an unfolded state in which the folding slat deck is horizontally oriented and a folded state in which the folding slat deck is vertically oriented such that the folding slat deck separates the enclosure into a top portion and bottom portion when the folding slat deck is horizontally oriented in the unfolded state, and combines the top portion and the bottom portion of the enclosure into a single usable space when the folding slat deck is vertically oriented in the folded state.

5. The chest of claim 4, wherein a first one of the folding slat deck and the side panels includes protrusions and a second one of the folding slat deck and the side panels include openings corresponding to the protrusions such that the folding slat deck is pivotably connected to the side panels.

6. The chest of claim 4, wherein the folding slat deck forms an upper portion of the sleeping platform when the folding slat deck is in the unfolded state.

7. The chest of claim 4, wherein the foldable mattress is storable in the single usable space when the folding slat deck is in the folded state.

8. The chest of claim 1, further comprising:

the foldable mattress, the foldable mattress configured to transition between a folded position and an unfolded position based on whether the chest is in the closed position and the open position, respectively.

9. The chest of claim 8, wherein the foldable mattress is in the folded position when stored in the enclosure, and the foldable mattress is in the unfolded position when the foldable mattress is supported by the sleeping platform.

10. The chest of claim 1, further comprising:

at least one lift tray attached to one or more of the side panels and extending away from the chest, the at least one lift tray configured to support items placed thereon.

11. The chest of claim 10, wherein the at least one lift tray includes a pair of lift trays each attached to a respective one of the sides panels.

12. The chest of claim 1, further comprising:

a back panel connected to the side panels such that the back panel is parallel to the front panel when the chest is in the closed position.

13. The chest of claim 12, wherein the back panel is a headboard when the chest is in the open position.

14. A chest configured to transition between an open position and a closed position, the chest including an enclosure configured to store a foldable mattress supported by a sleeping platform when the foldable mattress is in an unfolded state, the chest comprising:

a top panel, a front panel, and side panels, the top panel configured to be manually lifted vertically off of the chest to separate the top panel from the front panel such that the top panel is subsequently positionable to form a lower portion of the sleeping platform while a top portion thereof remains oriented in a same direction as prior to separation from the front panel, wherein the front panel is configured to transition between an upward position and a downward position, the front panel configured to form a middle portion of the sleeping platform when the front panel is in the downward position.

15. The chest of claim 14, wherein the front panel includes an upper front panel hingedly connected to a lower front panel, the upper front panel configured to transition between the upward position and the downward position.

16. The chest of claim 15, wherein the chest further comprises:

a folding leg assembly connected to the upper front panel, the folding leg assembly configured to transition between a folded state and an unfolded state depending on whether the chest is in the closed position or the open position.

17. The chest of claim 16, wherein the folding leg assembly includes legs and a lock, the lock configured to lock the folding leg assembly in the unfolded state such that the legs contact a floor when the chest is in the open position to support the middle portion of the sleeping platform.

18. The chest of claim 15, wherein the front panel is a roll-out front panel, the roll-out front panel including a front leg assembly and a rear leg assembly, the front leg assembly and rear leg assembly both being rigidly connected to the roll-out front panel, the front leg assembly including rollers such that the roll-out front panel is configured to roll away from the chest when the chest is transitioning from the closed position to the open position.

19. The chest of claim 15, wherein the front panel is a hook-on front panel, the hook-on front panel including clawed edges corresponding to divots on an end of the top panel and the side panels such that, when the chest is in the open position, the hook-on front panel lies perpendicular to a direction of the hook-on front panel in the closed position and is suspended from by the clawed edges connecting to the end of the top panel and the side panels to form the middle portion of the sleeping platform.

20. A chest configured to transition between an open position and a closed position, the chest including an enclosure configured to store a foldable mattress supported by a sleeping platform when the foldable mattress is in an unfolded state, the chest comprising:

a top panel, a front panel, and side panels, the top panel configured to be manually lifted vertically off of the chest to separate the top panel from the front panel such that the top panel is subsequently positionable to form a lower portion of the sleeping platform while a top portion thereof remains oriented in a same direction as prior to separation from the front panel; and a folding slat deck within the enclosure, the folding slat deck configured to transition between an unfolded state in which the folding slat deck is horizontally oriented and a folded state in which the folding slat deck is vertically oriented such that the folding slat deck separates the enclosure into a top portion and bottom portion when the folding slat deck is horizontally oriented in the unfolded state and combines the top portion and the bottom portion of the enclosure into a single usable space when the folding slat deck is vertically oriented in the folded state.

* * * * *